US011585596B2

(12) United States Patent
Hwang

(10) Patent No.: US 11,585,596 B2
(45) Date of Patent: Feb. 21, 2023

(54) REFRIGERATOR AND METHOD FOR CONTROLLING THE SAME

(71) Applicant: LG Electronics Inc., Seoul (KR)

(72) Inventor: Minkyu Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 483 days.

(21) Appl. No.: 16/706,482

(22) Filed: Dec. 6, 2019

(65) Prior Publication Data

US 2020/0182539 A1 Jun. 11, 2020

(30) Foreign Application Priority Data

Dec. 7, 2018 (KR) ..... 10-2018-0157264

(51) Int. Cl.
*F25D 11/02* (2006.01)
*F25D 29/00* (2006.01)
(Continued)

(52) U.S. Cl.
CPC ..... *F25D 29/003* (2013.01); *F25D 11/02* (2013.01); *F25D 23/02* (2013.01); *F25D 25/025* (2013.01); *F25D 2325/021* (2013.01)

(58) Field of Classification Search
CPC .... F25D 11/02; F25D 2325/021; F25D 23/02; F25D 23/021; F25D 2400/36;
(Continued)

(56) References Cited

U.S. PATENT DOCUMENTS 8,169,176 B2 * 5/2012 Yu ..... F25D 25/025 312/219
8,497,644 B2 * 7/2013 Eom ..... A47B 88/457 318/264
(Continued)

FOREIGN PATENT DOCUMENTS

CN 204787546 11/2015
CN 106322899 1/2017
(Continued)

OTHER PUBLICATIONS

Ge et al., "Drawer assembly and refrigerator", CN107388718 (A)—Nov. 24, 2017, eSpacenet, all (Year: 2017).*
(Continued)

*Primary Examiner* — Filip Zec
(74) *Attorney, Agent, or Firm* — Fish & Richardson P.C.

(57) ABSTRACT

A refrigerator includes an upper door, a lower door positioned below the upper door and configured to be extended out of and retracted into the lower storage chamber, wherein the lower door includes a drawer part having a storage space and a door part configured to open and close the lower storage chamber, respectively, a draw-out, an ascending and descending mechanism provided at the drawer part and configured to ascend and descend the storage space, a driving mechanism provided at the door part and configured to provide a driving force to the ascending and descending mechanism, a controller to control the driving mechanism, a microphone module provided at the upper door and configured to receive a voice input from a user, and a voice recognition module to allow the controller to control the driving mechanism in response to the voice input from the user.

19 Claims, 19 Drawing Sheets

(51) Int. Cl.
*F25D 23/02* (2006.01)
*F25D 25/02* (2006.01)

(58) Field of Classification Search
CPC ..... F25D 25/005; F25D 25/025; F25D 25/04; F25D 29/00; F25D 29/003; F25D 29/005
See application file for complete search history.

(56) References Cited

U.S. PATENT DOCUMENTS

| | | | | |
|---|---|---|---|---|
| 8,562,087 | B2 * | 10/2013 | Eom | F25D 25/025 312/331 |
| 2001/0025498 | A1 * | 10/2001 | Roh | F25D 29/00 62/132 |
| 2002/0007486 | A1 * | 1/2002 | Yun | F25D 29/00 348/E7.079 |
| 2010/0219730 | A1 | 9/2010 | Watts et al. | |
| 2010/0236281 | A1 | 9/2010 | Eom et al. | |
| 2015/0308158 | A1 * | 10/2015 | Jeon | E05B 65/0042 312/405 |
| 2017/0370636 | A1 | 12/2017 | Koo et al. | |
| 2018/0189027 | A1 * | 7/2018 | Jeon | G10L 15/22 |

FOREIGN PATENT DOCUMENTS

| | | |
|---|---|---|
| CN | 107024070 | 8/2017 |
| CN | 107388718 | 11/2017 |
| CN | 207113398 | 3/2018 |
| CN | 107940855 | 4/2018 |
| CN | 108151408 | 6/2018 |
| CN | 108917283 | 11/2018 |
| EP | 2401568 | 1/2012 |
| JP | 2017133818 | 8/2017 |
| KR | 1020060025806 | 3/2006 |
| KR | 20060096730 | 9/2006 |
| KR | 20150006264 | 1/2015 |
| KR | 1020160099523 | 8/2016 |
| KR | 1020170027247 | 3/2017 |
| KR | 1020180079835 | 7/2018 |
| KR | 1020180110978 | 10/2018 |

OTHER PUBLICATIONS

Extended European Search Report in European Appln. No. 19213191.0, dated Sep. 10, 2020, 12 pages.
Chinese Office Action in Chinese Appln. No. 201911223080.6, dated Mar. 23, 2021, 18 pages (with English translation).
European Search Report in European Appln. No. 19213191.0, dated May 11, 2020, 7 pages.
Korean Office Action in Korean Appln. No. 120020128403, dated Apr. 23, 2020, 16 pages (with English translation).
KR Notice of Allowance in Korean Appln. No. 10-2018-0157264, dated Dec. 22, 2020, 12 pages (with English translation).

* cited by examiner

REFRIGERATOR AND METHOD FOR CONTROLLING THE SAME

CROSS-REFERENCE TO RELATED APPLICATIONS

The present application claims priority under 35 U.S.C. 119 and 35 U.S.C. 365 to Korean Patent Application No. 10-2018-0157264, filed on Dec. 7, 2018, which is hereby incorporated by reference in its entirety.

TECHNICAL FIELD

The present disclosure relates to a refrigerator and a method for controlling the same.

BACKGROUND

Generally, a refrigerator is a household appliance that makes it possible to store food at low temperatures in an internal storage space that is shielded by a door. For this purpose, the refrigerator is configured to store the stored food in an optimum state by cooling the inside of the storage space via the cool air generated from the heat exchange with the refrigerant circulating in the refrigeration cycle.

Recently, refrigerators have become increasingly large and multifunctional in accordance with changes in diet and product trends. A refrigerator having various convenience devices for improving user's convenience has been introduced.

In recent years, various refrigerators have been developed to enable a user to control the operation of a refrigerator using voice. In the case of a refrigerator, there may be a problem that the door cannot be manually opened or the manipulator of the refrigerator is not accessible when an object is held in both hands of the user. To solve this problem, a refrigerator has been developed in which a microphone is placed in a refrigerator and a user's voice input can be used to control the operation thereof.

SUMMARY

According to one aspect of the subject matter described in this application, a refrigerator includes an upper door configured to open and close the upper storage chamber, a lower door positioned below the upper door and configured to be extended out of and retracted into the lower storage chamber, wherein the lower door includes a drawer part having a storage space defined therein and a door part configured to open and close the lower storage chamber based on the lower door being extended and retracted, respectively, a draw-out rail provided between an inner surface of the lower storage chamber and an outer face of the lower door, the draw-out rail being configured to guide a movement of the lower door into and out of the lower storage chamber, an ascending and descending mechanism provided at the drawer part and configured to ascend and descend the storage space, a driving mechanism provided at the door part and configured to provide a driving force to the ascending and descending mechanism, a controller provided at the cabinet and configured to control the driving mechanism, a microphone module provided at the upper door and configured to receive a voice input from a user, and a voice recognition module configured to allow the controller to control the driving mechanism in response to the voice input from the user.

Implementations according to this aspect may include one or more of the following features. For example, the voice recognition module may include a communication unit configured to communicate with a remote server, wherein the communication unit is configured to transmit the voice input from the voice recognition module to the server and subsequently receive a processing result of the voice input from the server. The controller may be configured to control the driving mechanism based on the processing result received from the server. The upper door may include a display configured to indicate an operation status of the refrigerator, and the display may be electrically connected to the voice recognition module and configured to display the processing result received from the server. In some cases, the communication unit may be configured, based on the server receiving a voice signal that includes a predefined voice or word, to initiate communication between the server and the voice recognition module.

In some implementations, the driving mechanism may include: a retracting and extending motor disposed at one side of the cabinet and configured to provide power for retracting or extending the lower door; and an ascending and descending motor linked to the ascending and descending mechanism and configured to provide power for ascending and descending the ascending and descending mechanism. The controller may be configured to sequentially operate the retracting and extending motor and the ascending and descending motor in response to the voice input from the user, the ascending and descending mechanism being configured to ascend based on the lower door being extended or the lower door being configured to retracted based on the ascending and descending mechanism being descended. The controller may be configured to operate one of the retracting and extending motor or the ascending and descending motor in response to the voice input from the user.

In some cases, a top of the upper door may define a top recess that is configured to receive therein the microphone module and the voice recognition module, a cover may be disposed to block an open top face of the top recess, a microphone-module mount on which the microphone module is mounted may be provided on the cover, and a voice input hole may be defined in the microphone-module mount. The microphone-module mount may include: a protrusion protruding upward from the cover; and an inclined portion extending forward from a front face of the protrusion, wherein the inclined portion has a bottom face inclined downward in a front direction. Here, the voice input hole may be defined in the inclined portion. In some cases, a hole guide may protrude around the voice input hole, and a protrusion dimension of the hole guide may decrease in a downward direction such that a bottom face of the hole guide has a slope greater than a slope of the bottom face of the inclined portion.

In some cases, the microphone module may include: a microphone substrate extending along and disposed on the inclined portion, wherein a substrate hole is defined in the microphone substrate at a position corresponding to the voice input hole; a sealing member disposed on a front face of the microphone substrate to seal between the microphone substrate and the inclined portion; and a microphone element placed on a rear face of the microphone substrate to block the substrate hole. Here, the sealing member may have a through-hole defined therein that is in communication with the voice input hole and the substrate hole. In some cases, two microphone elements may be disposed on both sides of the microphone substrate respectively, the voice input hole may include two voice input holes, the substrate hole may include two substrate holes, the through-hole may include two through-holes, and the two voice input holes, the two substrate holes, and the two through-holes may be aligned linearly with the two microphone elements, respectively.

In some implementations, a microphone-module support supporting the microphone module thereon may be mounted on a bottom face of the microphone-module mount. Additionally, the microphone-module support may include a mounting face portion in contact with and coupled to the protrusion and a supporting face portion extending from a front end of the mounting face portion at a same inclination angle as the inclined portion. Also, the microphone module may be mounted on the supporting face portion. In some cases, the refrigerator may further include a speaker module received in the top recess, the speaker module being electrically connected to the voice recognition module, and a speaker-module receiving portion may be recessed in the cover, the speaker module being received in the speaker-module receiving portion.

According to another aspect of the subject matter described in this application, a method for controlling a refrigerator is provided, wherein the refrigerator has an upper door for opening and closing an upper storage space in a cabinet, a lower door for opening and closing a lower storage space in the cabinet, wherein the lower door is configured to retract into or extend from the lower storage space, an ascending and descending mechanism for ascending and descending the lower door, a driving mechanism for supplying power for retracting and extending the lower door or for ascending and descending of the ascending and descending mechanism or both, a controller disposed on the cabinet for controlling the driving mechanism, a microphone module disposed on the upper door for receiving a voice from a user, and a voice recognition module disposed on the upper door and electrically connected to the microphone module and controller, wherein the voice recognition module is configured to communicate with a remote server. The method includes transmitting a voice signal of the user from the microphone module to the voice recognition module, transmitting the voice signal from the voice recognition module to the server, processing the voice signal by the server and transmitting a processing result from the server back to the voice recognition module, and controlling, by the controller, the driving mechanism to be activated based on the processing result.

Implementations according to this aspect may include one or more of the following features. For example, the method may further include initiating communication between the server and the voice recognition module based on the server receiving the voice signal that includes a predefined voice or word. In some cases, the driving mechanism of the refrigerator being controlled under this method may include a retracting and extending motor disposed at one side of the cabinet for supplying power for retracting or extending the lower door thereto, and an ascending and descending motor linked to the ascending and descending mechanism for supplying power for ascending and descending the ascending and descending mechanism thereto. Here, the controller may be configured to operate the retracting and extending motor or the ascending and descending motor or both based on the processing result from the server. In some cases, the controller may be configured to sequentially operate the retracting and extending motor and the ascending and descending motor in response to the voice from the user, the ascending and descending mechanism being configured to ascend based on the lower door being extended or the lower door being configured to retracted based on the ascending and descending mechanism being descended. In some cases, the controller may be configured to activate one of the retracting and extending motor or the ascending and descending motor in response to the voice from the user.

DETAILED DESCRIPTION

In the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various implementations are illustrated and described further below. It will be understood that the description herein is not intended to limit the claims to the specific implementations described. On the contrary, it is intended to cover alternatives, modifications, and equivalents as may be included within the spirit and scope of the present disclosure as defined by the appended claims.

The present disclosure describes, for example, a refrigerator having an upper pivotable and a lower drawer type door for convenience of description and understanding. The present disclosure is not limited thereto. It should be noted that the present disclosure may be applied to all types of refrigerators equipped with a retractable or extendable door as a drawer type door.

Figure 1:
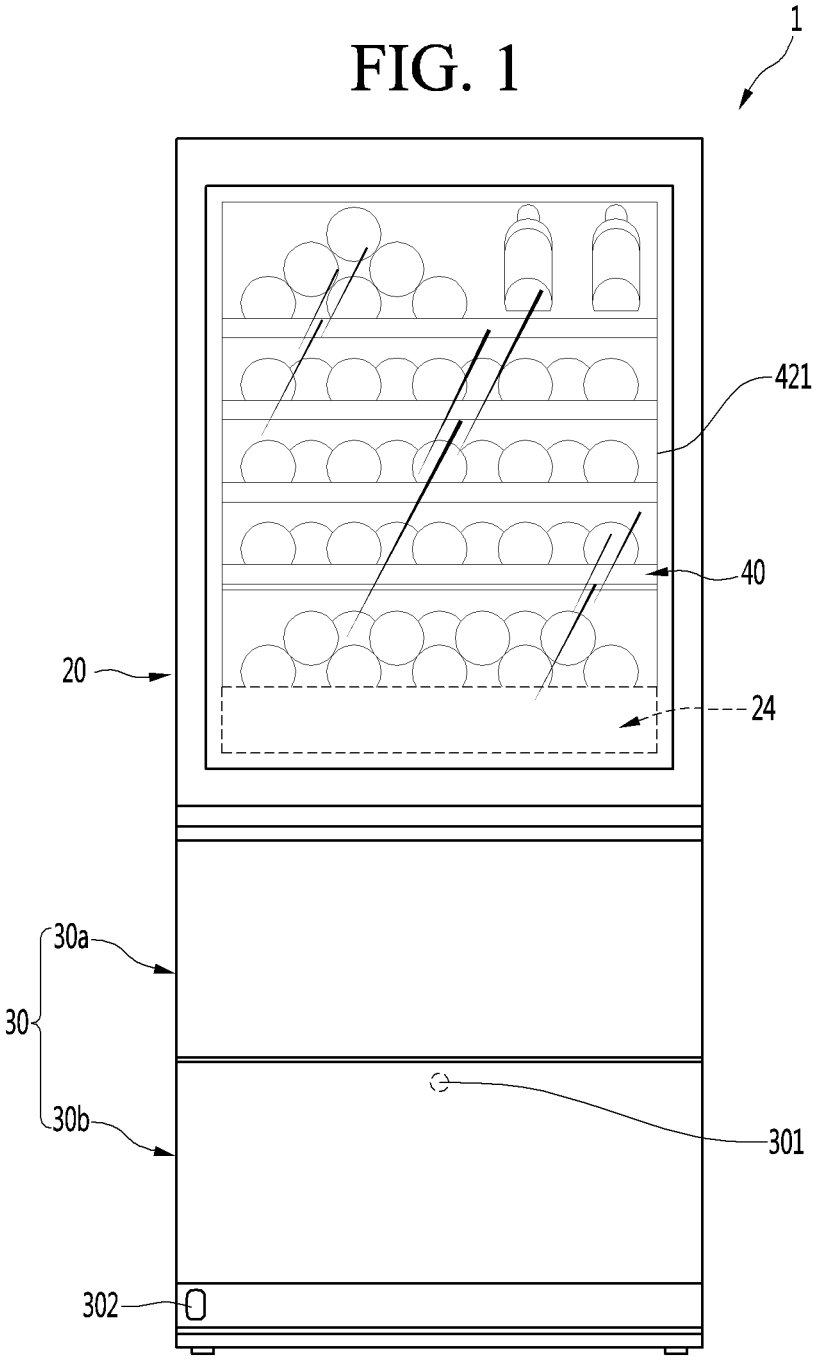
FIG. 1 is a front view of an example refrigerator according to an implementation of the present disclosure.
Figure 2:
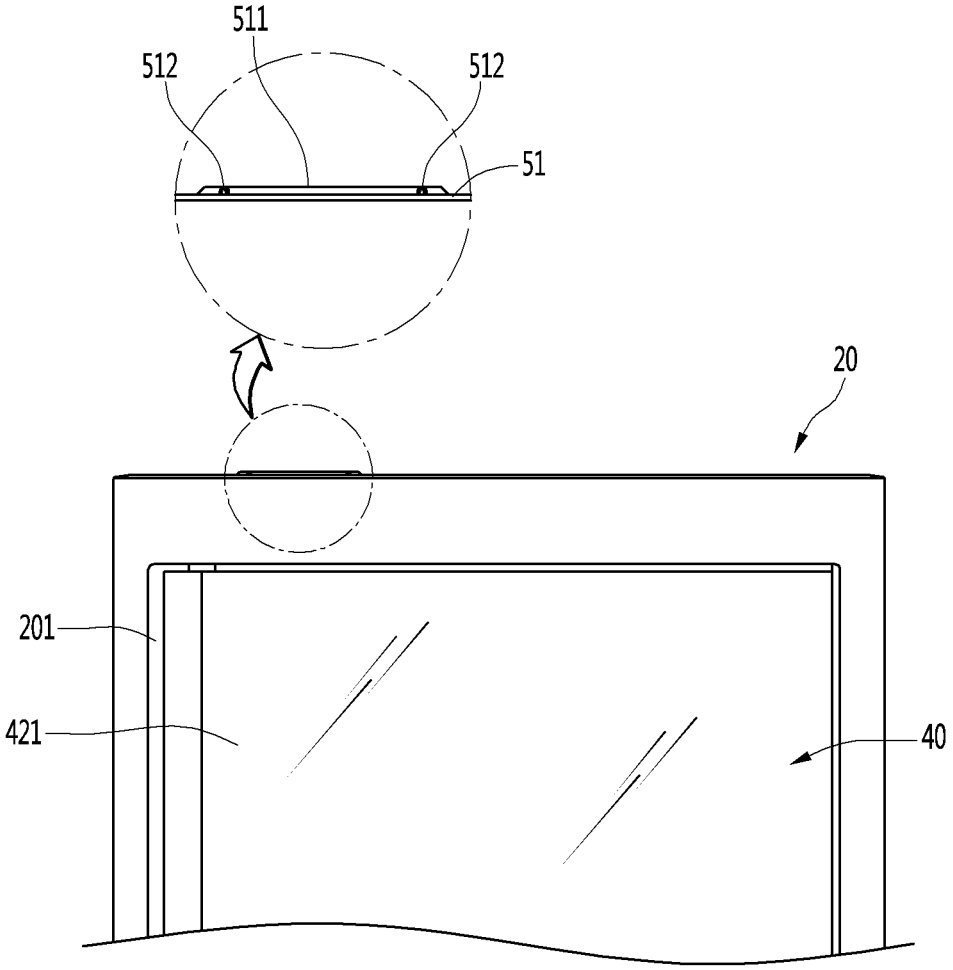
FIG. 2 is an enlarged view of a top of an upper door a refrigerator.

FIG. 1 is a front view of a refrigerator according to an implementation of the present disclosure. FIG. 2 is an enlarged view of a top of an upper door of the refrigerator.

A refrigerator 1 according to an implementation of the present disclosure includes a cabinet 10 having a storage compartment defined therein and doors 20 and 30 for opening and closing the cabinet 10.

In the cabinet 10, the storage compartment may be divided into an upper storage compartment 11 and a lower storage compartment 12. The partitioned upper and lower storage compartments may be maintained at different temperatures. Then, the door may include an upper door 20 for opening and closing the upper storage compartment and at least one lower door 30 for opening and closing the lower storage compartment.

The upper door 20 may be pivotally mounted to the cabinet 10 and may be configured to open and close the upper storage compartment 11 pivotally. Thus, the upper door 20 may be referred to as a pivotable door. Then, the lower door 30 may be retractably or extendably mounted to the cabinet 10 and may be configured to open and close the lower storage compartment 12 in a retracting or extending manner. Thus, the lower door 30 may be referred to as a drawer type door or a retractable or extendable door. The lower door 30 may be composed of a plurality of sub lower doors. Then, the sub lower doors 30 may be arranged vertically. In one example, the lower door may include an upper drawer type door 30*a* and a lower drawer type door 30*b*.

The upper door 20 has an auxiliary door 40 for opening or closing a central opening 201 defined therein while pivotably mounted thereto. The auxiliary door 40 may at least partially transparent so that the interior of the refrigerator can be viewed through the auxiliary door 40. In some cases, the auxiliary door 40 may be composed of a plurality of glass panels be thermally insulated from surroundings. A transparent display may be provided in the auxiliary door 40 to display a screen. Then, the manipulation of the user may allow the auxiliary door 40 to be selectively transparent or opaque. Thus, the interior of the upper storage compartment 11 may be selectively visible or invisible to the user.

A front face of the auxiliary door 40 may be formed by the front panel 421. The front panel 421 may define the majority of the area of the front face of the auxiliary door 40 so that most of the interior of the upper storage compartment 11 may be viewed substantially through the auxiliary door 40.

A display 24 may be disposed below the opening 201. The display 24 may be configured to be visible from the outside through the auxiliary door 40. On the display 24, the operation state or the setting state of the refrigerator 1 may be output. In particular, the display 24 may output the operation setting status of the lower door 30.

For example, the ascended or descended state of the lower door 30 or the setting state for ascending and descending may be displayed on the display 24. That is, when the lower door 30 is in a state ready for retracting or extending and ascending or descending operations in response to the user's voice input, the display 24 may output that the lower door 30 is in the ready state. Then, when the lower door 30 is in a state ready for retracting or extending and ascending or descending operations in response to direct manipulation of the manipulation part 301 or 302 by the user, the display 24 may output that the lower door 30 is in the ready state. Further, when the lower door 30 is in a state ready only for the retracting or extending operation or the ascending or descending operation in response to the user's voice input, the display 24 may output that the lower door 30 is in the ready state.

The display 24 may output that the lower door 30 has been retracted or extended or may output that the lower door 30 is being retracted or extended. Further, the display 24 may output that the lower door 30 has ascended and descended or may output that the lower door 30 is being ascended and descended.

Figure 3:
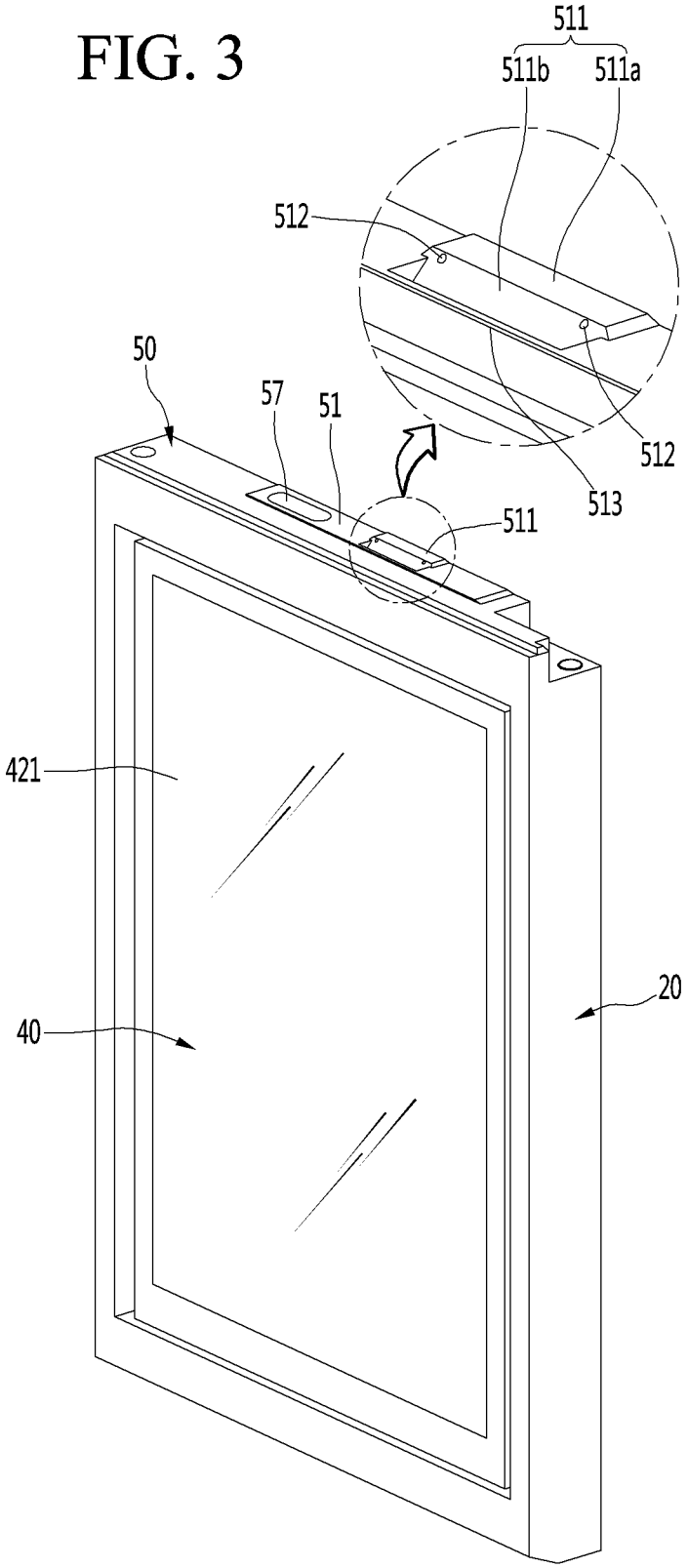
FIG. 3 is a perspective view of the upper door.
Figure 4:
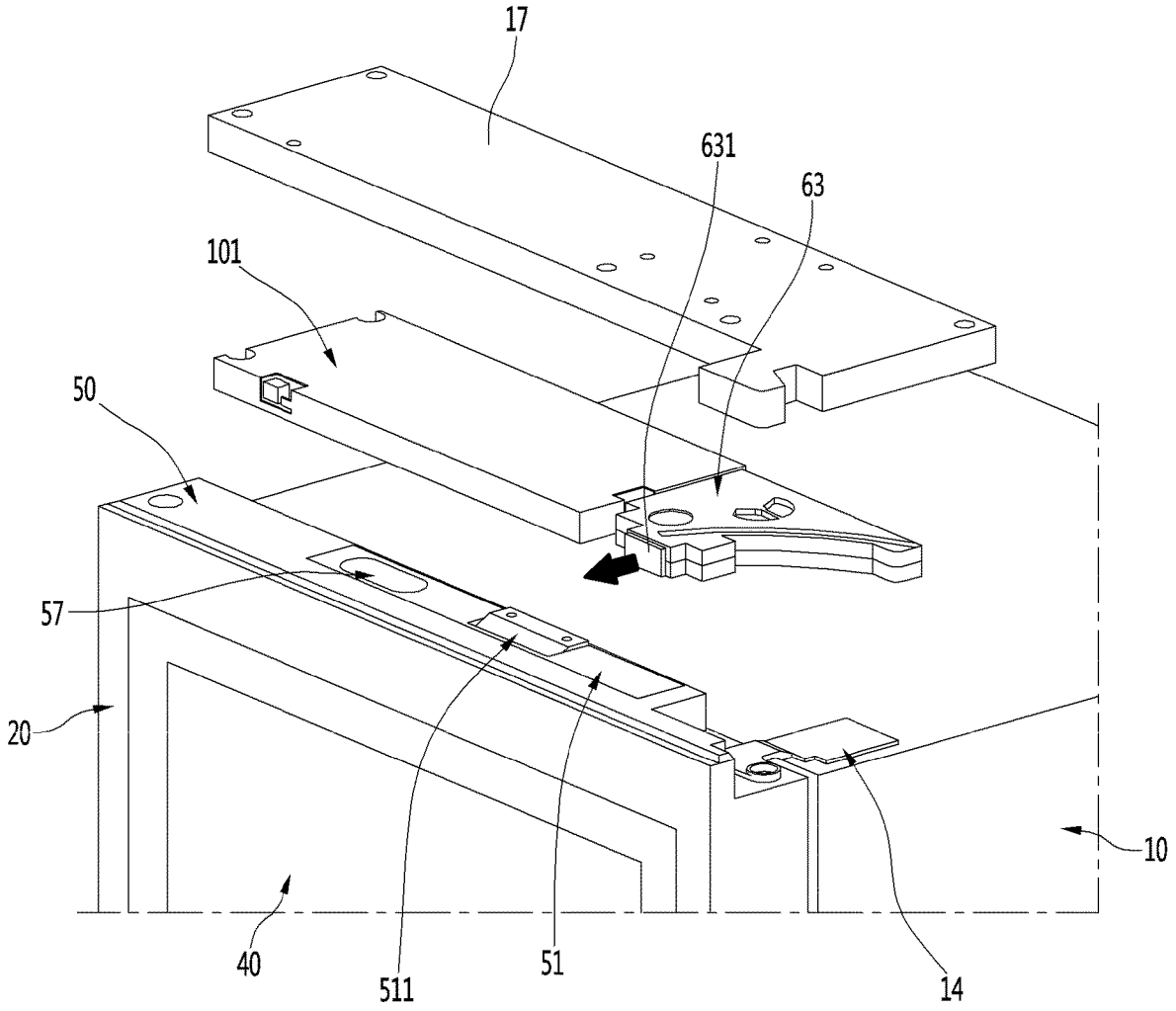
FIG. 4 is an exploded perspective view showing a top joint structure of the upper door.

FIG. 2 is an enlarged view of a top of the upper door of the refrigerator. FIG. 3 is a perspective view of the upper door. FIG. 4 is an exploded perspective view showing a top joint structure of the upper door.

A controller 101 may be provided on the top face of the door cabinet 10. A door opening mechanism 63 may be provided adjacent to the controller 101. The door opening mechanism 63 is configured such that a push rod 631 may be retracted or extended. When the push rod 631 is extended, the push rod may push a rear of the upper door 20 to be open. When the push rod 631 is retracted, the upper door 20 may be closed by its own weight.

The controller 101 and the door opening mechanism 63 may be mounted on the top face of the cabinet 10. The top portion of the cabinet 10 may include a main casing 17 which accommodates both the controller 101 and the door opening mechanism 63, as well as a hinge mechanism 14 for opening and closing the upper door 20.

The controller 101 may be connected to the door opening mechanism 63. The door opening mechanism 63 may be configured to work in response to input of the user's voice command. That is, without the manipulation of a separate button, the door opening mechanism 63 may be activated by the user's voice.

In one example, the upper door 20 has a relatively thin structure. Thus, the relatively large door opening mechanism 63 is unable to be positioned in the cap decoration 50 but is mounted on the cabinet 10 to pivot the upper door 20 in a pushing manner.

The door opening mechanism 63 is disposed on a lateral side of the cabinet 10 so that the upper door 20 may be slim in thickness. Even with a slim structure of the upper door 20, an insulation loss of the upper door 20 can be minimized.

The upper door 20 may be formed by combining an outer plate 21 forming an outer appearance including a front face and a door liner forming a back face thereof. The space between the outer plate 21 and the door liner may be filled with an insulation material. Then, a cap decoration 50 may be provided on the top face of the upper door 20.

A microphone-module mount 511 on which a microphone module 53 for receiving a user's voice is mounted may protrude from the top face of the upper door 20. The microphone module 53 may be accommodated in the interior space of the cap decoration 50. Then, the inner space of the cap decoration 50 may be shielded with a cover 51. The microphone-module mount 511 may be formed on the cover 51.

Further, the microphone-module mount 511 may be disposed in an area between the left and right ends of the upper door 20. Thus, when a user speaks in at center of the refrigerator 1, the user voice can be recognized more effectively.

The microphone-module mount 511 may be virtually invisible when viewed from the front due to the characteristics in terms of the shape. Since the height of the refrigerator is usually larger than the user's height, the microphone-module mount 511 will not be visible to the user in a normal use environment.

Then, the microphone-module mount 511 may include a protrusion 511*a*, an inclined portion 511*b*, and a depression 513. A sound input hole 512 may be defined in the inclined portion 511*b*. Therefore, the microphone-module mount 511 and the sound input hole 512 defined in the microphone-module mount 511 may be invisible even when the user is in a position away from the refrigerator 1.

Thus, the microphone-module mount 511 may have a position and structure that ensures a high voice recognition ability while minimizing exposure thereof to the outside. Hereinafter, the structure of the microphone-module mount 511 and the microphone module 53 will be described in more detail.

Figure 5:
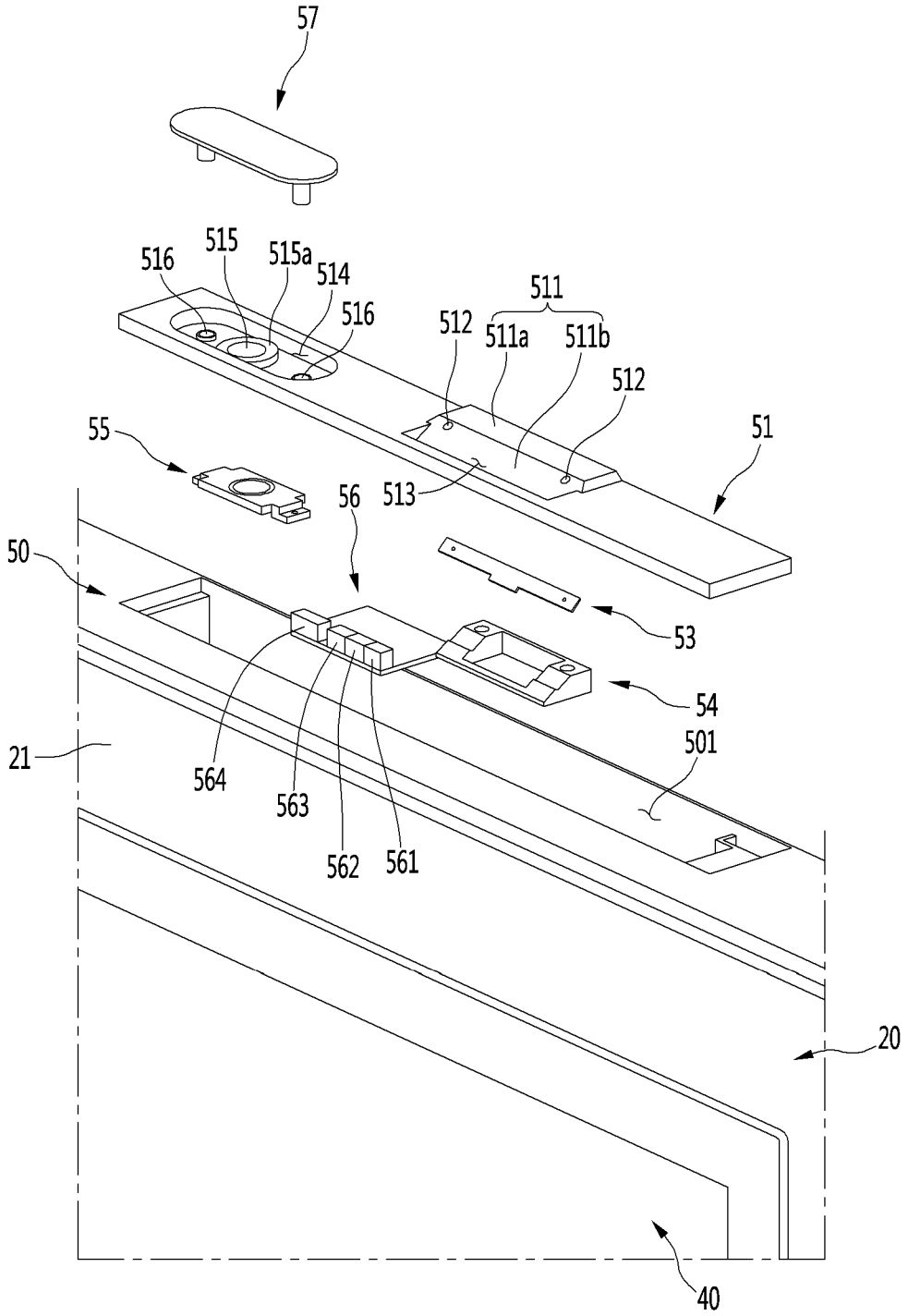
FIG. 5 is an exploded perspective view showing a coupling structure of a cover module and a speaker module and a microphone module mounted on a top of the upper door.

FIG. 5 is an exploded perspective view showing a coupling structure of a cover module and a speaker module and a microphone module mounted on a top of the upper door.

The cap decoration 50 may be formed on the top face of the door 20. The cap decoration 50 is combined with the door liner and the outer plate 21 to form the top face of the door 20. The interior space of the door 20 defined by the outer plate 21 and the door liner and the cap decoration 50 may be filled with an insulation material.

The cap decoration 50 may have a top recess 501 that extends in a downward direction. The top recess 501 may be defined except for the periphery of the cap decoration 50.

The microphone module 53, the speaker module 55, and a voice recognition module 56 may be accommodated inside the top recess 501. A cover 51 for shielding the opened top face of the top recess 501 may be provided.

The microphone module 53 may be configured for receiving voice of a user for operation control of the refrigerator 1 and may be mounted on the microphone-module mount 511 formed on the cover 51. The microphone module 53 may be in close contact with the bottom face of the cover 51 and may be supported by a microphone-module support 54. The microphone-module mount 511 may further have a sound input hole 512 defined therein. Through the sound input hole 512, the user's voice may be input into the microphone module 53 mounted within the microphone-module mount 511.

The speaker module 55 is configured for outputting sound, and outputs information such as operation status information of the refrigerator 1 or user's request information. The speaker module 55 may be mounted on a bottom face of the speaker-module mount 514 formed on the cover 51. The speaker module 55 may be fixedly mounted on the cover 51.

The voice recognition module 56 may be coupled to the microphone module 53 and the speaker module 55. The voice recognition module 56 may recognize a voice upon receiving a voice signal input from the microphone module 53. Accordingly, the voice recognition module 56 may be referred to as a voice recognition PCB (printed circuit board).

The voice recognition module 56 may convert the voice signal input from the microphone module 53 to the electrical signal and transmit the electrical signal to a remote server. Thus, the voice recognition module 56 may be formed with a minimum size required for the signal process so as to be received within a very narrow space of the upper door 20. Thus, a space required for placing the voice recognition module 56 in the upper door 20 may be minimized. That is, this configuration of the microphone module 53 may allow the loss of the insulation space of the upper door 20 to be minimized. Thus, a size of the auxiliary door 40 may be made as large as possible to enable the interior space of the refrigerator to be more visible.

In one example, the voice recognition module 56 may be coupled to the speaker module 55 and may process the voice signal and then send the processed signal back to the speaker module 55.

The voice recognition module 56 may be fixedly mounted to the inner bottom face defining the top recess 501. Then, the voice recognition module 56 may include a plurality of connectors 561, 562, 563 and 564. In detail, the connectors 561, 562, 563, and 564 may include a first connector 562 and a second connector 563 connected to a pair of the microphone modules 53 respectively, a third connector 561 connected to the speaker module 55, and a fourth connector 564 supplied with power. Thus, the speaker module 55 or the microphone module 53 may be simply separated from the upper door and thus may be maintained or replaced as needed. Thus, the user may selectively use the microphone module 53 and the speaker module 55 according to the model specification of the refrigerator 1.

The cover 51 may be formed in a plate shape corresponding to a shape of the top recess 501 and may be mounted to shield the top recess 501. When the cover 51 is mounted on the cap decoration 50, the cover may define the top face of the upper door 20. Thus, the microphone module 53 and the speaker module 55 may be fixedly mounted to the cover. That is, the microphone module 53 and the speaker module 55 may be mounted on the upper door 20, and may be mounted on the cover 51 and may be suspended the inside of the top recess 501.

In particular, the microphone module 53 remains as depending from the bottom face of the cover 51. Thus, the noise introduced into the microphone module 53 may be minimized. For example, in the refrigerator 1, due to the nature of the operation thereof, noises or vibrations of the mechanisms such as the compressor of the refrigeration cycle during the operation of the refrigeration cycle are continuously generated. However, in the present example, this vibration or noise may be prevented from being transmitted along the door 20 to the microphone module 53.

Therefore, the microphone module 53 may be installed in the upper door 20 not to be exposed to the outside, and may be spaced from an inner portion of the upper door 20, so that the noise caused by the operation of the refrigerator 1 may be minimized. This may improve voice recognition ability, for instance.

In one example, the cap decoration 50 may be covered with the cover 51. The cover 51 may shield the top recess 501. The microphone module 53 and the speaker module 55 may be fixedly mounted to the cover 51. To this end, the microphone-module mount 511 and the speaker-module mount 514 may be formed on the cover 51.

Figure 6:
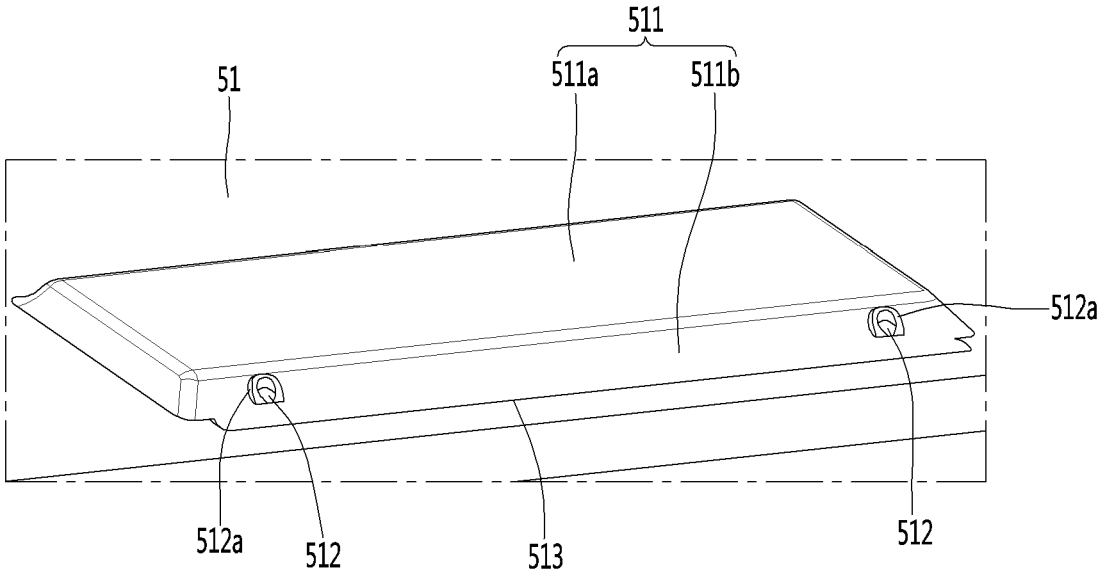
FIG. 6 is a partial enlargement of the microphone-module mount according to an implementation of the present disclosure.
Figure 7:
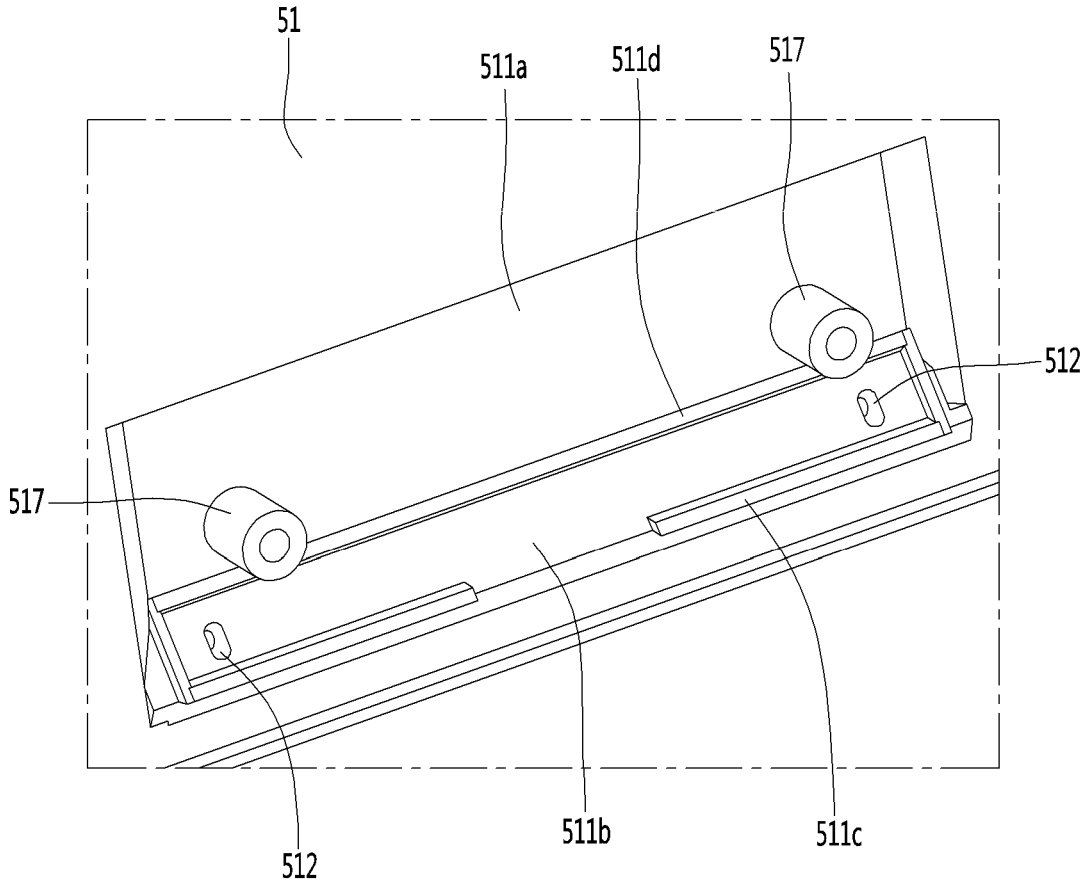
FIG. 7 is a bottom perspective view of the microphone-module mount.
Figure 8:
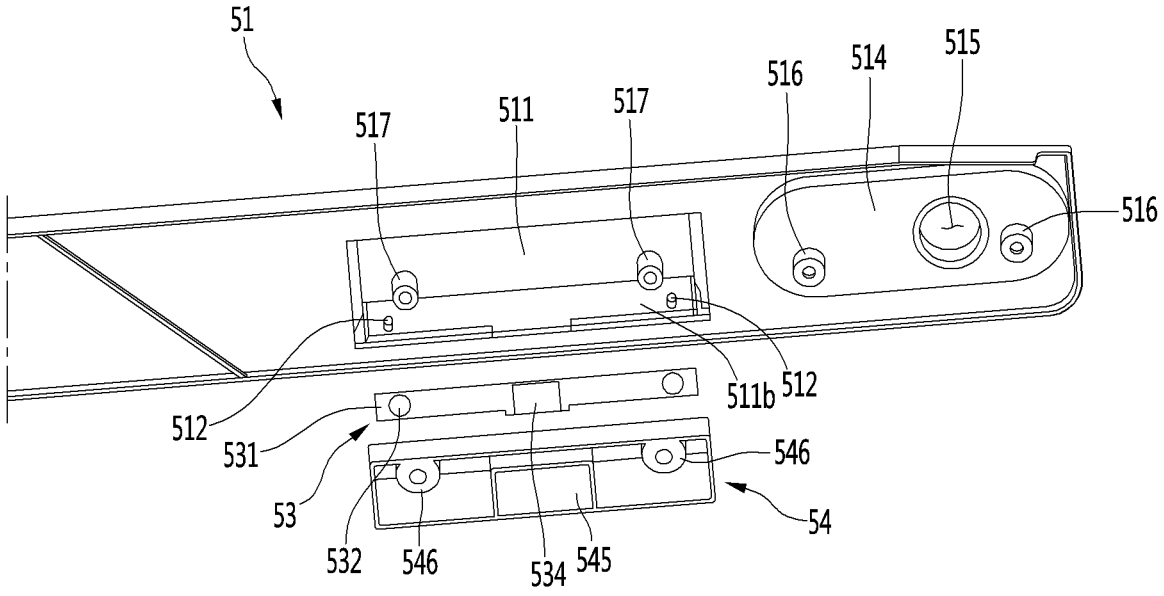
FIG. 8 is an exploded perspective view showing a mounting structure of the microphone module.

FIG. 6 is a partial enlargement of the microphone-module mount according to an implementation of the present disclosure. FIG. 7 is a bottom perspective view of the microphone-module mount. FIG. 8 is an exploded perspective view showing a mounting structure of the microphone module.

As shown, the microphone-module mount 511 may be formed on the door cover 51. The microphone-module mount 511 may include a protrusion 511*a* protruding upward from the door cover 51, an inclined portion 511*b* formed at the front end of the protrusion 511*a*, and a depression 513 formed at an end of the inclined portion 511*b*.

The protrusion 511*a* may protrude to have a top face in parallel with the top face of the door cover 51 and have the highest level of the microphone-module mount 511. A microphone-module mounting boss 517 may be formed underneath the protrusion 511*a*. The microphone-module mounting boss 517 may be formed at each of left and right sides and may be inserted into a through-hole 546 of the microphone-module support 54. A screw S may be fastened to the microphone-module mounting boss 517 in the through hole 546 so that the microphone-module support 54 may be fixedly mounted to the bottom face of the protrusion 511*a*.

The protrusion height of the protrusion 511*a* may be sized such that a proper size of the voice input hole 512 may be defined in the inclined portion 511*b*. The protrusion height of the protrusion 511*a* may be sized such that then viewed from the front, the microphone-module mount 511 is invisible. For example, the height of the protrusion 511*a* may be set to have a height of 2 mm to 3 mm.

The inclined portion 511*b* may be formed at the front end of the microphone-module mount 511 and have a top face inclined downwardly as it extends in a front direction. The inclined portion 511*b* may have a top face of a slope of 30 to 50 degrees.

The inclined portion 511*b* may be formed to have a predetermined width and may have a corresponding size and shape so that the microphone module 53 may be in close contact with the bottom surface of the inclined portion 511*b*. A front rib 511*c* and a rear rib 511*d* for fixing the microphone module 53 to the inclined portion may protrude downwards from the bottom surface of the inclined portion 511*b*. The front rib 511*c* and rear rib 511*d* may extend laterally along the front end and rear end of the bottom face of the inclined portion 511*b*, respectively. Thus, the microphone module 53 may be fitted into between the front rib 511*c* and the rear rib 511*d*.

The microphone module 53 may be mounted at the correct position between the front rib 511*c* and the rear rib 511*d*. The voice input hole 512 formed in the inclined portion 511*b* may be aligned with a microphone element 532 of the microphone module 53.

The voice input hole 512 is defined in the inclined portion 511*b*. The voice input hole 512 may be defined at a position corresponding to a center of the microphone element 532. Thus, the user's voice may be effectively input through the voice input hole 512 to the microphone element 532. For this purpose, the sound input hole 512 is disposed at a single extension line between the through-hole 533*a* of the sealing member 533 and a substrate hole 531*a* formed in a microphone substrate 531, so that the voice of the user can be effectively transmitted to the microphone element 532.

The voice input hole 512 may be defined in left and right sides of the inclined portion 511*b*. That is, each of the voice input hole 512 and the corresponding microphone element 532 may be provided in a paired manner. Thus, a voice having passed through the pair of voice input holes 512 may be input to the pair of the microphone elements 532.

Each of a spacing between the pair of the voice input holes 512 and a spacing between the pair of the microphone elements 532 may preferably be approximately 5 mm to 10 mm when considering a typical location of the user. This spacing may allow more effectively analyzing and processing the voice input to the microphone element 532, thereby to improve the voice recognition performance.

A hole guide 512*a* may be formed around the voice input hole 512. The hole guide 512*a* may be constructed to protrude along the periphery of the voice input hole 512, and may be formed such that a protruding height thereof decreases as it goes downwardly. Accordingly, when the dust or foreign matter falls from above, the hole guide 512*a* prevents dust or foreign matter from being directly introduced into the voice input hole 512, so that the dust or foreign matter may flow down and may be guided to the depression 513.

Further, the hole guide 512*a* is formed on the inclined portion 511*b*. However, a top face of the hole guide 512*a* has a larger slope than the top face of the inclined portion 511*b* so that the voice from the user in front thereof may be delivered more effectively towards the voice input hole 512.

Further, the voice input hole 512 is facing forwards. In this connection, the hole guide 512*a* may be formed around the voice input hole 512 to prevent sound output from the speaker module 55 from re-entering the microphone element 532. Further, preferably, the speaker-module receiving portion 514 may be spaced from the microphone-module mount 511 or the voice input hole 512 by at least 80 mm to 120 mm.

In one example, the depression 513 may be defined in front of the inclined portion 511*b*. The depression 513 may be recessed downward from the end of the inclined portion 511*b* so that dust or foreign matter falling from above is gathered therein. Therefore, even when dust or foreign matter falls from above and accumulates on the door cover 51, the voice input hole 512 cannot be easily clogged by the dust.

That is, the dust or foreign matter flowing along the inclined portion 511*b* is accommodated in the depression 513 in front of the inclined portion 511*b*. Thus, the voice input hole 512 may not be clogged until the depression 513 is completely filled with the dust or debris which then overflows out of the depression 513, such that the voice recognition performance from the user may be maintained reliably.

In one example, the door cover 51 may have a speaker-module receiving portion 514 formed therein, on which the speaker module 55 is mounted. The speaker-module receiving portion 514 may be defined to be depressed downwardly in one area of the door cover 5. The speaker module 55 may be mounted on the bottom face of the speaker-module receiving portion 514.

A sound output hole 515 may be defined in the center of the speaker-module receiving portion 514. An edge protrusion 515*a* may be formed around the sound output hole 515. The edge protrusion 515*a* may have a protruding height so as not to touch the speaker-module cover 57. The edge protrusion 515*a* can prevent dust or foreign matter from being introduced into the speaker-module receiving portion 514 from entering the speaker module 55.

In one example, a sound output unit 550 of the speaker module 55 is disposed in an inner space defined by the edge protrusion 515*a*, that is, at a position corresponding to the sound output hole 515. Accordingly, the sound output from the sound output unit 550 can be output to the outside through the sound output hole 515 without leaking into the door 20.

Further, the speaker-module receiving portion 514 may have a pair of speaker-module mounting female bosses 516. The speaker-module mounting female boss 516 may be formed on each of both sides around the sound output hole 515. The speaker-module mounting male bosses 572 extend downward from the cover 57 and extends to a speaker-module wing 552 at each of both sides.

Further, the speaker-module receiving portion 514 may blocked by the speaker-module cover 57. The speaker-module cover 57 may include a plate portion 571 and speaker-module mounting male bosses 572. The plate portion 571 is formed in a plate shape. The plate portion 571 may have a shape corresponding to that of the speaker-module receiving portion 514 and may have a slightly smaller size than that of the speaker-module receiving portion 514. Thus, when the speaker-module cover 57 is mounted on the speaker-module receiving portion 514, a perimeter of the speaker-module receiving portion 514 and a perimeter of the speaker-module cover 57 are spaced apart from each other. Thus, the sound output from the speaker module 55 may leak out through the spacing therebetween.

The speaker-module mounting male boss 572 may extend downward from the bottom face of the speaker-module cover 57. The speaker-module mounting male boss 572 may extend through the speaker-module mounting female boss 516 to the speaker-module wing 552. A screw S may pass through the speaker-module wing 552 and then may be fastened to the speaker-module mounting male boss 572 so that the speaker-module cover 57 and the speaker module 55 are fixedly mounted on the door cover 51.

Figure 9:
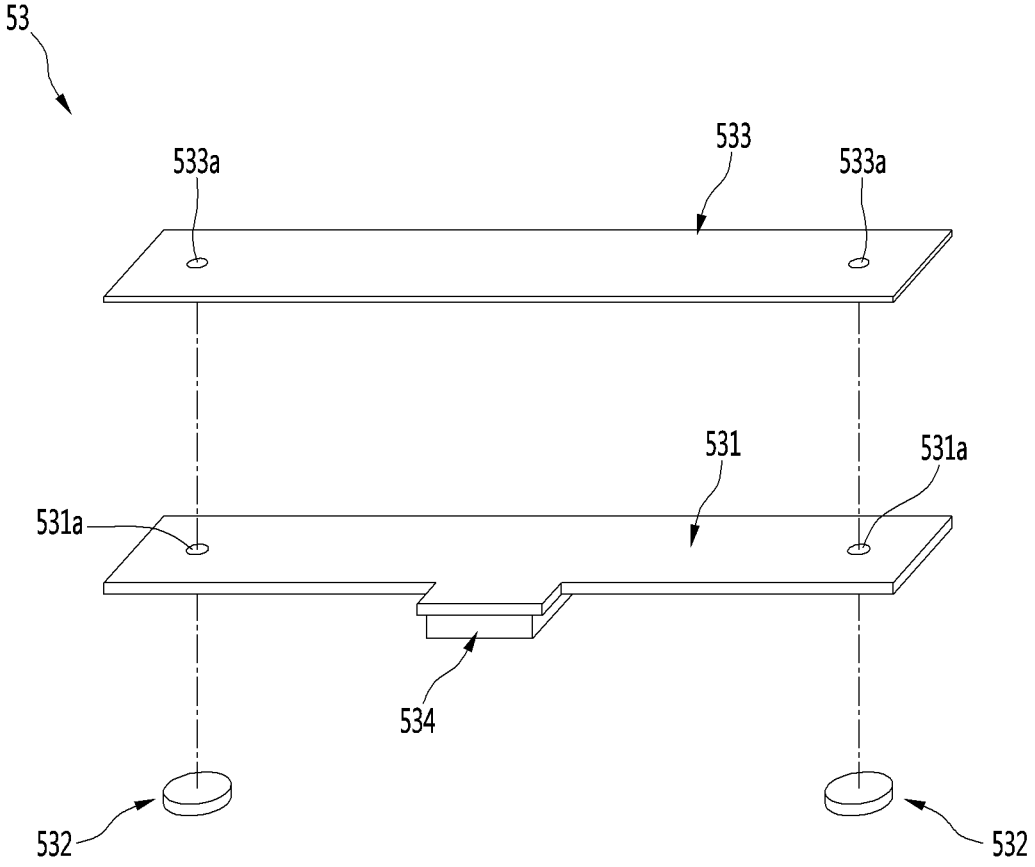
FIG. 9 is an exploded perspective view of the microphone module.

FIG. 9 is an exploded perspective view of the microphone module.

Referring to the microphone module 53 based on the drawing, the microphone module 53 may include a microphone substrate 531, a microphone element 532, and a sealing member 533. The microphone module 53 includes at least one microphone element 532 and may be called a microphone.

Specifically, the microphone substrate 531 is configured for allowing the microphone elements 532 to be mounted thereon and supported thereon to be spaced from each other by a predetermined spaced distance. Further, in both sides of the microphone substrate 531, substrate hole s531*a* penetrating the microphone substrate 531 may be formed therein. The substrate holes 531*a* may be formed at positions corresponding to the microphone elements 532. Thus, the voice of the user may be transmitted to the microphone element 532. The microphone substrate 531 may be elongated in the length direction so as to be mountable to the inclined portion 511*b* of the microphone-module mount 511.

A microphone connector 534 is formed on the center of the bottom face of the microphone substrate 531. The microphone connector 534 may protrude downwards (that is, in a direction away from the cap decoration) and be inserted into a connector hole 545 defined in the microphone-module support 54. Thus, the first and second connectors 563 of the voice recognition module 56 and the microphone connector 534 may be connected to each other by a harness having at both ends connected to the connectors without interference from the microphone-module support 54.

The microphone element 532 may receive voice input and may be mounted on each of both sides of the top face of the microphone substrate 531. The microphone element 532 may be located at a position corresponding to the voice input hole 512 when the microphone module 53 is mounted on the mount 511, so that the user's voice may be input to the element 532. The microphone element 532 may employ various elements having structures capable of receiving voice input from the user. In one example, the microphone element 532 may be a variety of devices that may receive voice input. Therefore, the microphone element 532 may be referred to as a microphone or microphone device.

The microphone element 532 may be positioned on the bottom face of the microphone substrate 531 and may be formed at a position corresponding to the substrate hole 531*a* of the microphone substrate 531 and the through-hole 533*a* of the sealing member 533. Thus, incoming voice from the sound input hole 512 may in turn pass through the through-hole 533*a* and then the substrate hole 531*a* and then may be introduced into the microphone element 532.

Then, the microphone element 532 and the microphone connector 534 may all be provided on the bottom face of the microphone substrate 531. Therefore, the top face of the microphone substrate 531 may be formed in a planar shape and may be in close contact with the bottom face of the cover 51, that is, the bottom face of the microphone-module mount 511.

In one example, the sealing member 533 is disposed on each of both sides of the top face of the microphone substrate 531 and surrounds the microphone element 532. The sealing member 533 may be disposed at each of both ends of the microphone substrate 531 and may be disposed between and in tight contact with the microphone substrate 531 and the inclined portion 511*b* of the microphone-module mount 511.

The sealing member 533 may be made of a material having elasticity and may be adhered to the top face of the microphone substrate 531 and the bottom face of the inclined portion 511*b*. The sealing member 533 may completely hermetically seal between the top face of the microphone substrate 531 and the bottom face of the inclined portion 511*b* so that external voice is directed toward the microphone element 532 without leakage of the voice. The sealing member may prevent internal noise in the upper door 20 from entering the microphone element. As the sealing member 533, an adhesive tape or a double-sided tape may be used. When the sealing member 533 is formed of an adhesive material, the microphone module 53 may be attached and fixed substantially to the microphone-module mount 511. In this connection, the sealing member 533 may be referred to as an adhesive member or a fixing member.

Through-holes 533*a* are formed on both sides of the sealing member 533. The through-holes 533*a* may be disposed at the single extension line from the microphone element 532 and the substrate hole 531*a*. Thus, the sealing member 533 may act as a passage through which the voice is transmitted to the microphone element 532, as well as may fix the microphone module 53.

Further, the sealing member 533 may effectively buffer shock or vibration generated when the door 20 is opened or closed due to the nature of the use environment of the door 20. Further, the sealing member 533 may allow the mounting position of the microphone module 53 to be maintained and the element 532 to be sealed so that excellent voice recognition performance can be maintained. Further, vibrations and shocks from the cabinet 10 during the operation of the refrigerator 1 may also be mitigated by the sealing member 533.

Figure 10:
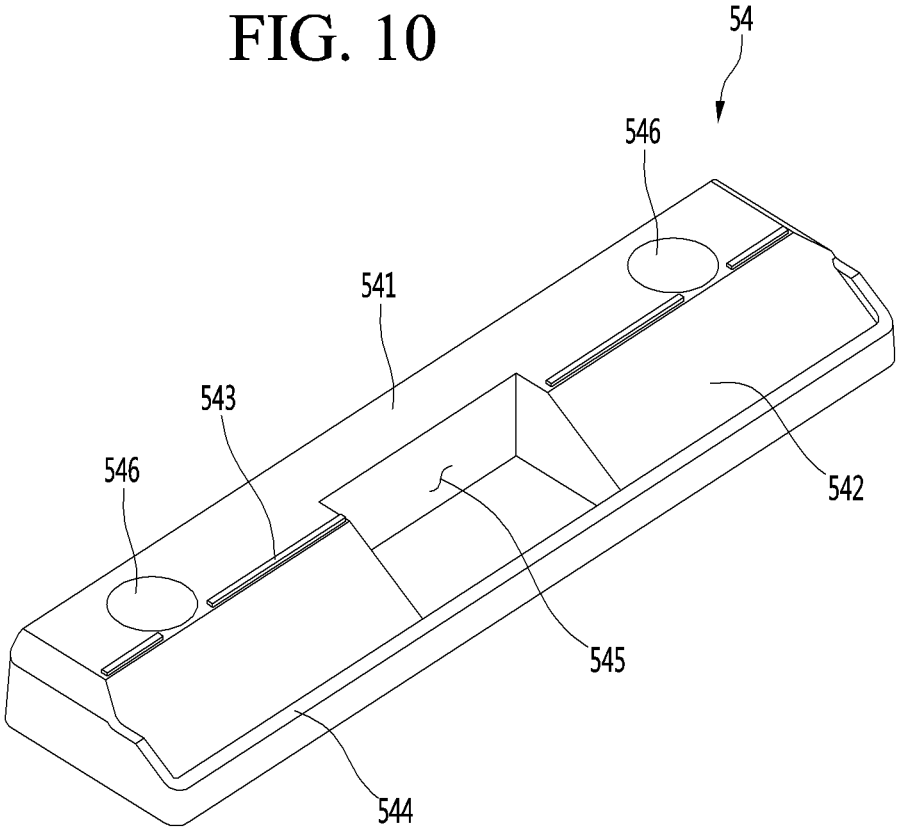
FIG. 10 is a perspective view of a microphone-module support according to an implementation of the present disclosure.

FIG. 10 is a perspective view of a microphone-module support according to an implementation of the present disclosure.

As shown in the figure, the microphone-module support 54 is mounted on the door cover 51 so that the microphone module 53 can be tightly fixed to the inclined portion 511*b* of the door cover 51. The top face of the microphone-module support 54 may include a mounting face 541 and a supporting face 542.

The mounting face 541 is configured for mounting the microphone-module support 54 on the cover 51. The face 541 may be parallel to the bottom face of the door cover 51. More specifically, the face 541 may be parallel to the bottom face of the protrusion 511*a*. A pair of supporter through-holes 546 may be respectively defined in both sides of the mounting face 541 to penetrate the microphone-module support 54 in the up-and-down direction. The screw S may upwardly pass through the supporter through-hole 546 and be fastened to the microphone-module mounting male boss 517.

The supporting face 542 is formed in front of the mounting face 541 and is inclined downwardly as it goes in the front direction. The supporting face 542 may be sized such that the microphone module 53 is mounted thereon. The face 542 may be constructed to have a slope corresponding to the inclined portion 511*b* of the microphone-module mount 511. Thus, the microphone module 53 may be disposed between the inclined portion 511*b* and the supporting face 542.

Moreover, from a rear end of the supporting face 542, an upper rib 543 may protrude to be in contact with the rear rib 511*d*. A lower rib 544 to be in contact with the front rib 511*c* may protrude from the front end of the supporting face 542.

The lower rib 544 has a predetermined height. The lower rib 544 may define an edge protrusion extending upward along a front edge and a portion of a side edge of the microphone-module support 54. Accordingly, when the microphone-module support 54 is mounted on the cover 51, the front rib 511*c* and the rear rib 511*d* may be positioned between the upper rib 543 and the lower rib 544, while the depression 513 of the microphone-module mount 511 may be inserted into a space between the supporting face 542 and the lower rib 544.

In accordance with this structure, the microphone-module support 54 can be mounted in the correct position. The guide structure of the ribs 511*c*, 511*d*, 543, and 544 guides the microphone-module support 54 to be mounted at an accurate position where optimal voice recognition performance can be maintained.

In one example, a connector hole 545 may be defined in the center of the microphone-module support 54. Thus, while the microphone module 53 is mounted on the supporting face 542, the microphone connector 534 may be exposed downwardly through the connector hole 545. Accordingly, the microphone module 53 may be connected to the voice recognition module 56 while the microphone module 53 is fixedly mounted on the door cover 51.

Figure 11:
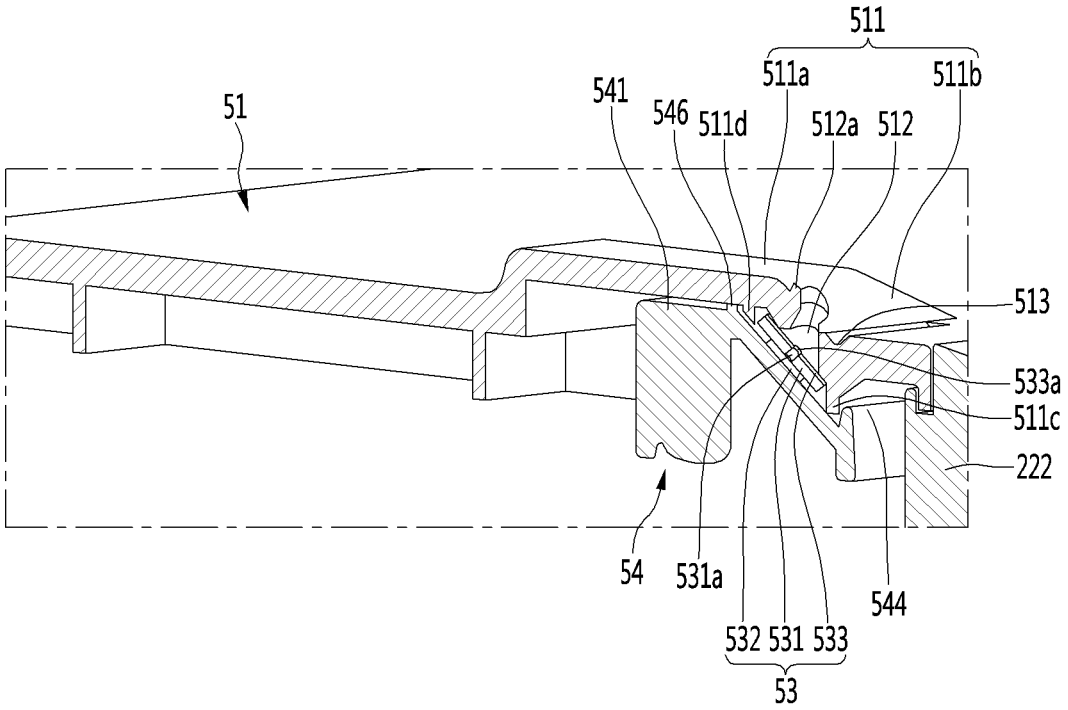
FIG. 11 is a cross-sectional view showing a coupling structure of the microphone module and microphone-module support.
Figure 12:
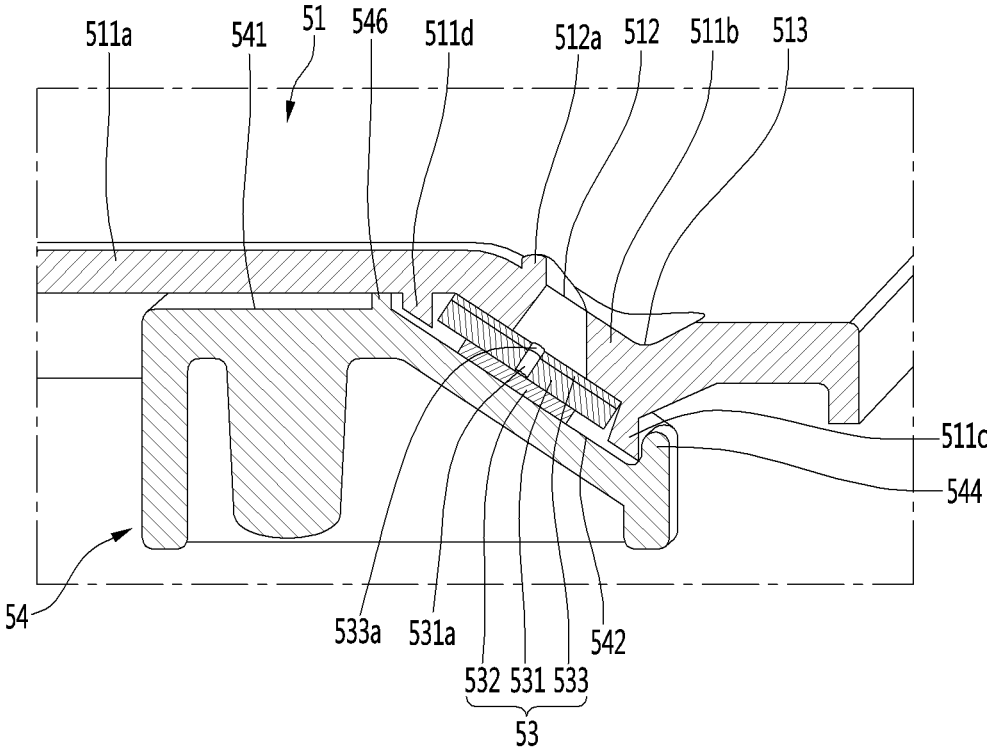
FIG. 12 is a partial enlargement of the coupling state of the microphone module and microphone-module support.

FIG. 11 is a cross-sectional view showing a coupling structure of the microphone module and microphone-module support. FIG. 12 is a partial enlargement of the coupling state of the microphone module and microphone-module support.

Referring to the mounting structure of the microphone module 53 in detail based on the drawings, the microphone module 53 is mounted on the supporting face 542 of the microphone-module support 54. In this connection, the microphone connector 534 is located inside the connector hole 545.

The microphone-module support 54 with the microphone module 53 mounted thereon is placed on the microphone-module mount 511. In this connection, the mounting face 541 of the microphone-module support 54 is mounted on the bottom face of the protrusion 511*a* of the microphone-module mount 511. Then, the screw S below the microphone-module support 54 passes through the supporter through-hole 546 and then is fastened to the microphone-module mounting male boss 517.

The upper rib 543 and the lower rib 544 may be coupled to the front rib 511*c* and the rear rib 511*d* respectively and may contact the outer faces of the front rib 511*c* and the rear rib 511*d* respectively while the screw S has been fastened to the boss 517. Thus, the microphone-module support 54 may be positioned in the correct position. As a result, the microphone element 532 of the microphone module 53 and the voice input hole 512 can be aligned with each other.

Further, the microphone module 53 is located in the space between the front rib 511*c* and the rear rib 511*d*. The sealing member 533 of the microphone module 53 seals between the microphone substrate 531 and the bottom face of the inclined portion 511*b*.

Particularly, when the screw S for mounting the microphone-module support 54 to the cover 51 is completely tightened, the microphone-module support 54 presses the microphone module 53 against the bottom face of the inclined portion 511*b*. Thus, the sealing member 533 may be compressed to seal the space between the microphone substrate 531 and the back surface of the inclined portion 511*b*.

Thus, the voice entering the voice input hole 512 may pass through the through-hole 533*a* and substrate hole 531*a* and then may be completely transmitted to the microphone element 532 without leakage. In addition, unwanted noise is prevented from entering the microphone element 532.

In one example, the voice input hole 512 may be defined so that its diameter widens in a downward direction, that is, in a direction approaching the microphone element 532. Therefore, the voice introduced into the voice input hole 512 may be effectively transmitted to the microphone element 532 and minimize the generation of noise.

Hereinafter, the mounting structure of the speaker module 55 will be described in more detail with reference to the drawings.

Figure 13:
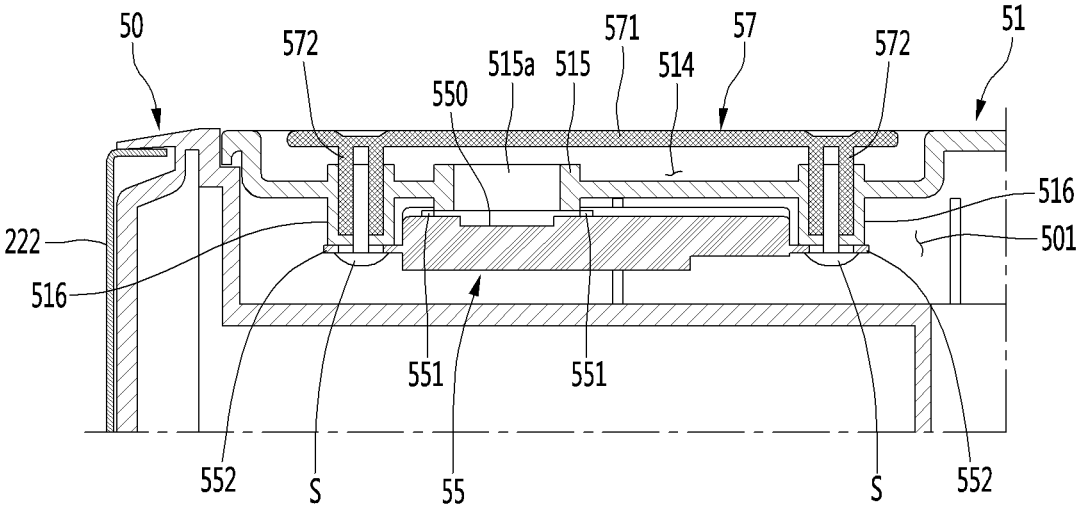
FIG. 13 is a cross-sectional view showing a mounting structure of the speaker module.

FIG. 13 is a cross section showing the mounting structure of the speaker module.

The speaker module, as shown, may be disposed on the bottom face of the speaker-module receiving portion 514. In this connection, a sound output unit 550 for outputting voice is present on the speaker module 55 to face the sound output hole 515. An output unit guide 551 may extend around the sound output unit 550. The output unit guide 551 may be constructed to abut the outer edge of the edge protrusion 515*a* formed on the speaker-module receiving portion 514. Thus, the speaker module 55 may be mounted in the correct position and the sound output from the sound output unit 550 may be transmitted externally through the sound output hole 515.

The speaker-module cover 57 covers the speaker-module receiving portion 514. The speaker-module mounting male boss 572 penetrates the speaker-module mounting female boss 516. The screw upwardly passing through the speaker-module wing 552 is coupled to the speaker-module mounting male boss 572 to couple the speaker-module cover 57 and the speaker module 55 together.

The speaker-module cover 57 may be flush with the top faces of the door cover 51 and the cap decoration 50 when the cover 57 is mounted on the speaker-module receiving portion 514. Then, the sound output to the speaker module 55 passes through the sound output hole 515 and then leaks between the periphery of the speaker-module cover 57 and the periphery of the speaker-module receiving portion 514.

Hereinafter, the operation of the refrigerator 1 having the above structure will be described.

Figure 14:
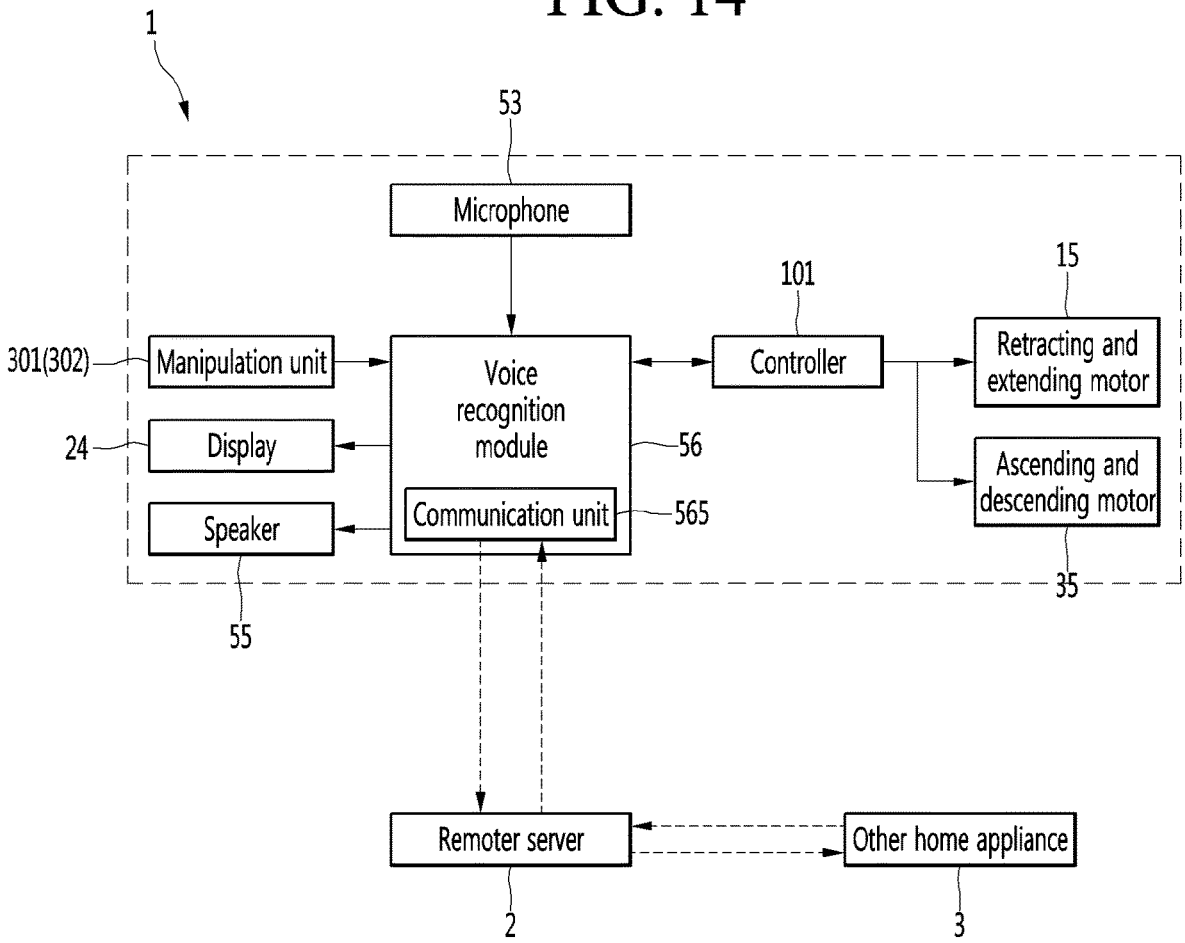
FIG. 14 is a block diagram illustrating an example control signal flow of the refrigerator.

FIG. 14 is a block diagram showing the control signal flow of the refrigerator.

As shown in the figure, the refrigerator 1 is operated under the control of the controller 101 to operate the refrigeration cycle including the compressor to cool the inside of the refrigerator. The controller 101 may be configured to control the overall electrical components inside the refrigerator and to receive signals from various sensors. The controller 101 controls the overall operation of the refrigerator and may be called a main PCB or controller.

To operate the refrigerator 1, the user operates the refrigerator 1 by directly manipulating the display 24 of the refrigerator 1 or the manipulation unit 301 or 302 provided on the door or cabinet. Further, the user inputs manipulation inputs to manipulate the temperature of the refrigerator 1, or to manipulate the performance of certain functions.

In one example, the user may control the operation of the refrigerator 1 by allowing the microphone module to recognize the user's voice at a remote location where the user is far away from the refrigerator or when the user cannot use both the hands.

For example, when a user speaks a set trigger voice in front of the refrigerator 1, the voice recognition mode is activated by the microphone module 53 and the voice recognition module 56. The user then enters the voice command for operation of the refrigerator 1.

In one example, the voice recognition module 56 includes a communication unit 565. Therefore, the voice recognition module 56 may communicate with the server 2 using the communication unit 565 and may process the voice signal inputted from the microphone module 53 and transmit the processed signal to the server 2. The communication may occur through various wired and/or wireless networking technologies, including but not limited to WiFi and Bluetooth, among others.

The server 2 receives the voice signal from the microphone module 53, analyzes the voice signal, and determines a voice command accordingly. Then, the server may process or analyze the received voice signal in a natural language form and then converts the same into text data, or the like. Then, the server may analyze the text data to determine the voice command, or may pass the analyzed data or text data to the refrigerator 1 or other home appliance 3 using the communication unit.

The server may include one or more of an Automatic Speech Recognition (ASR) server, a Natural Language Processing server (NLP server), or a Text to Speech (TTS) server. The Automatic Speech Recognition (ASR) server, Natural Language Processing server (NLP server), and Text to Speech (TTS) server may perform a complex operation in conjunction with each other.

Therefore, the process of analyzing and processing the voice signal received from the refrigerator 1 may be performed on the server 2. The processed data by the server 2 may be passed back to the voice recognition module 56 using the communication unit 565. Using this structure, the number of the components of the voice recognition module 56 can be minimized. In particular, the server 2, which is relatively free of volume and performance constraints may have excellent performance, and thus may perform analysis of voice signals, conversion of voice signals, and other additional tasks associated with the input voice signal.

For example, the server 2 may search information based on the received voice signal or compare the operation information of the refrigerator 1 with stored data to check the status thereof. Then, the information acquired using the server 2 may be passed back to the refrigerator 1 using the communication unit 565, which in turn may be output through the speaker module 55 or on the display 24. Further, the operation control of the refrigerator 1 may be carried out depending on the information delivered from the server 2.

The communication of the refrigerator 1 with the server 2 enables indirect communication between the server 2 and other home appliances 3 via the refrigerator 1. Thus, the server may execute operation control or obtain status information for other home appliances 3.

In one example, the voice recognition module 56 may be coupled to the controller 101. Therefore, the user's voice input may be used to control the operations of electrical components connected to the controller 101.

For example, the user may use the voice to input the retracting or extending and ascending or descending operations of the lower door 30. In other words, the user may control the driving mechanism for operation of the lower door 30 only by using the voice in the state where the hands of the user are not available.

The driving mechanism may include a retracting and extending motor 15 for retracting or extending the lower door 30 and an ascending and descending motor 35 for ascending and descending of the lower door 30. The user may control the operation of the driving mechanism using the user's voice.

Hereinafter, a structure and a control method for ascending and descending the lower door using a voice of a user will be described in detail with reference to the drawings.

Figure 15:
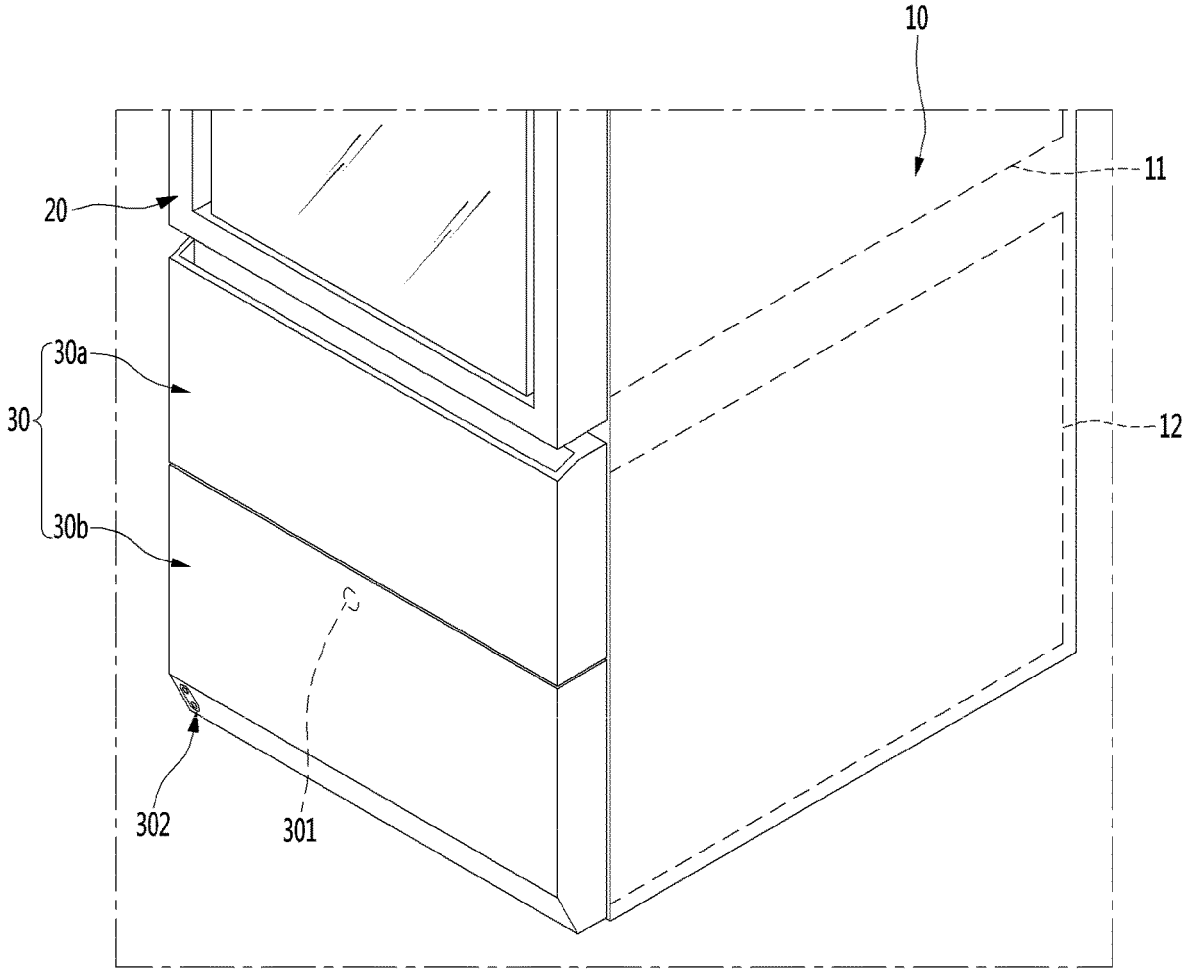
FIG. 15 is a perspective view of a state in which the lower door is closed in accordance with an implementation of the present disclosure.

FIG. 15 is a perspective view of a state in which the lower door is closed in accordance with one implementation of the present disclosure.

In the refrigerator 1, both the upper door 20 and the lower door 30 remain closed when the food is stored therein. In this state, the user may manipulate, that is, may retract or extend or ascend and descend the lower door 30 and then may store or withdraw the food therein or therefrom.

The user may manipulate manipulation units 301 and 302 provided on the front face or bottom face of the lower door 30 for retracting or extending the lower door 30. The manipulation units 301 and 302 may include a switch 301 on which the user may touch or press, and may be provided on the front face of the lower door 30, and a proximity sensor 302 as provided at the bottom of the lower door 30.

Further, when the user is holding an object in his hands or is unable to manipulate the manipulation unit 301 or 302 directly at a position remote therefrom, the user may use voice to input the retracting or extending or ascending or descending operation of the lower door 30.

Hereinafter, an example in which a lower drawer type door **30*b* among the drawer type doors 30 arranged vertically retracts or extends or ascends or descends may be described. However, the upper drawer type door 30*a* retracts or extends or ascends or descends in the same manner or using the same structure as those of the lower drawer type door 30*b***.

The following describes an example of controlling the operation of the lower door using the voice of the user.

Figure 16:
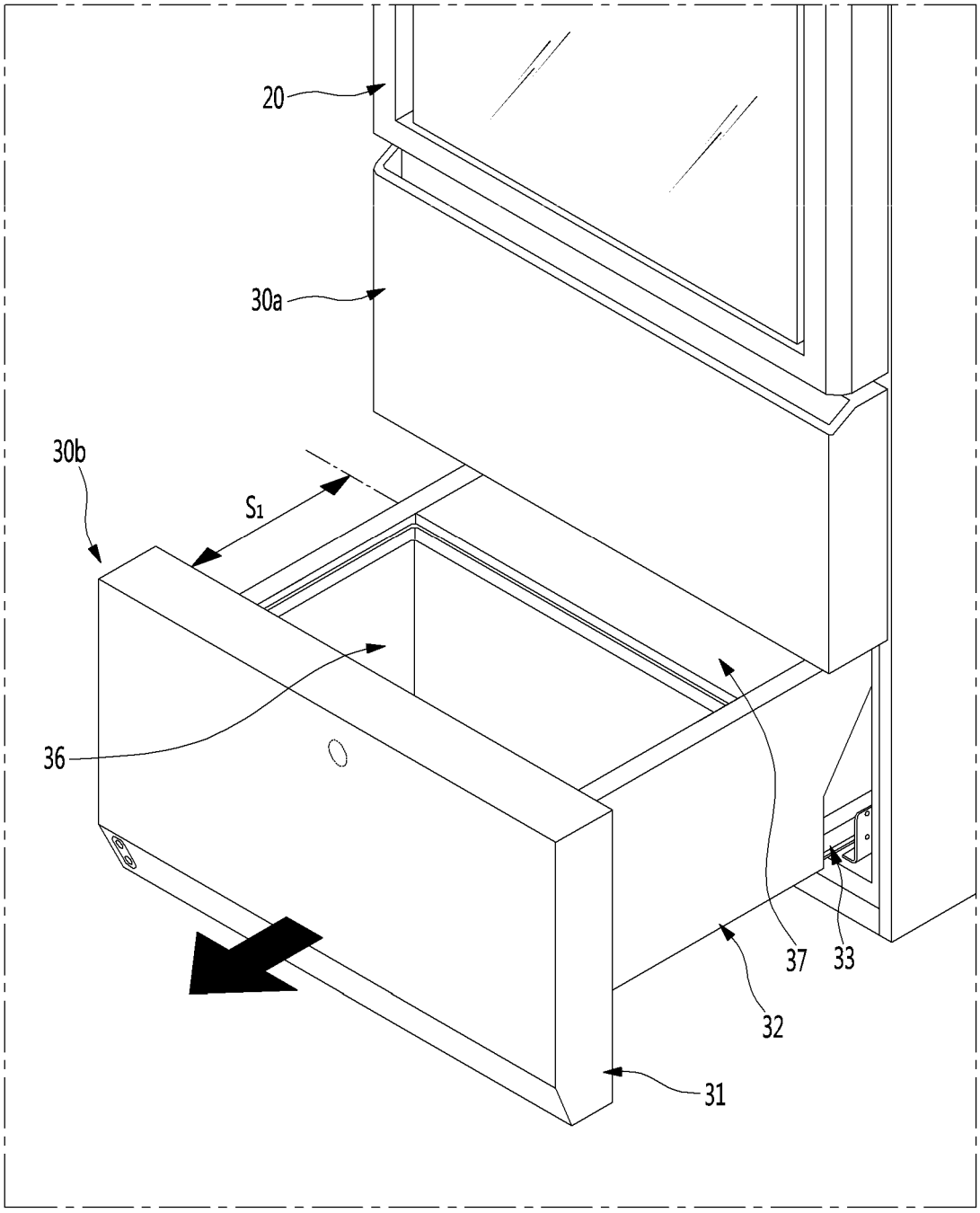
FIG. 16 is a perspective view of a state in which the lower door has been extended.
Figure 17:
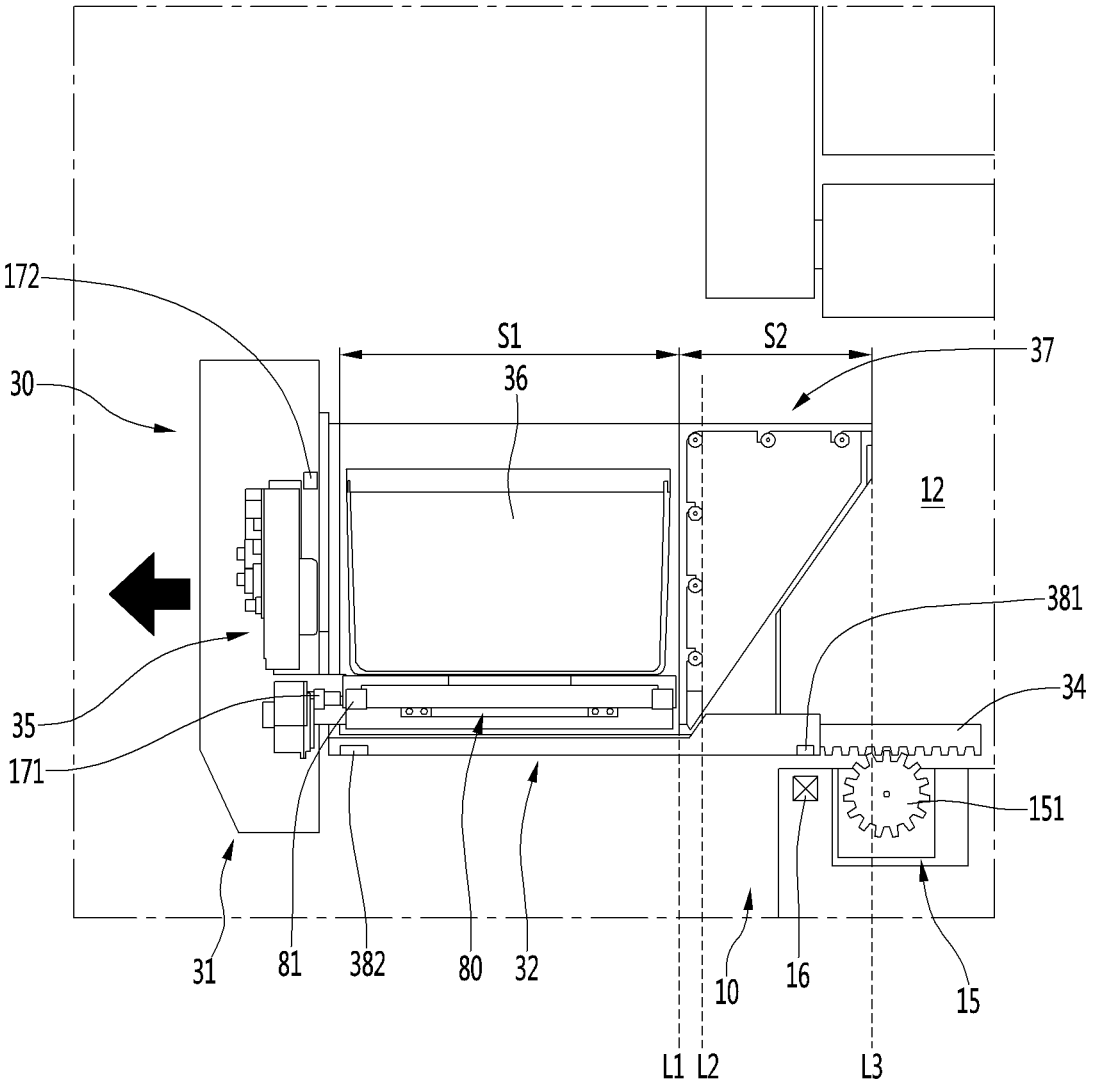
FIG. 17 shows an interior of the lower door of FIG. 16.

FIG. 16 is a perspective view of a state in which the lower door has been extended. FIG. 17 shows an interior of the lower door of FIG. 16.

As shown, when a user wishes to extend or retract or ascend or descend the lower drawer type door **30*b*, the user may input a specific voice within a set distance from the refrigerator 1 to indicate the operation of the lower drawer type door 30*b***.

The lower drawer type door **30*b* includes a drawer part 32 onto which a draw-out rail 33 is mounted and in which a container 36 and an ascending and descending mechanism 80 are received. The lower drawer type door 30*b* includes a door part 31 in which an ascending and descending motor 35 connected to the ascending and descending mechanism 80** is accommodated.

The user's extending manipulation of the lower drawer type door **30*b* may allow the lower drawer type door 30*b* to extend forwards. The lower drawer type door 30*b* may extend along the draw-out rail 33**.

In one example, the lower drawer type door 30*b* may be configured to retract or extend not manually but using a driving force from a retracting or extending motor 15 inside the cabinet 10.

A retracting or extending rack 34 provided on the bottom surface of the lower drawer type door 30*b* may be engaged with a pinion gear 151 rotated together with driving of the retracting or extending motor 15 provided in the cabinet 10. Therefore, as the retracting or extending motor 15 is driven, the lower drawer type door 30*b* may be retracted or extended. A minimum extendable distance of the lower drawer type door 30*b* may be configured such that a front space S1 inside the drawer part 32 accommodating the container 36 is fully exposed to the outside. While the front space S1 inside the drawer part 32 accommodating the container 36 is fully exposed to the outside, in the ascending and descending movements of the ascending and descending mechanism 80 inside the drawer part 32, the container 36 or the food therein may not interfere with the doors 20 and 30*a* or the cabinet 10 disposed above the container 36.

In this connection, the retracting or extending distance of the lower drawer type door 30*b* may be determined by a retracting or extending detection sensor disposed on the cabinet 10 and/or the lower drawer type door 30*b*. The retracting or extending detection sensor may sense that the lower drawer type door 30*b* is fully extended or closed. One example of the retracting or extending detection sensor may include a pair of magnets 381 and 382 provided on the draw-out rail 33 or the drawer part 32 and a magnetic sensor 16 provided on one side of the cabinet for sensing the magnets 381 and 382.

In another example, the retracting or extending detection sensor may be implemented as a switch positioned in the fully retracted position and the fully extended position of the lower drawer type door 30*b*, to sense the retracting or extending movement of the lower drawer type door 30*b*. In another example, the retracting or extending detection sensor may include a sensor that counts the number of rotations of the retracting or extending motor 15 or a sensor that measures the distance between the rear face of the door part 31 and the front face of the cabinet 10, to sense whether the lower drawer type door 30*b* is extended or retracted.

If it is detected that the lower drawer type door 30*b* has been fully extended, the ascending and descending motor 35 may be driven to operate the ascending and descending mechanism 80. The ascending and descending mechanism 80 may be configured to operate in a situation in which the lower drawer type door 30*b* is sufficiently extended to ensure safe ascending and descending of the food or container 36 seated in the ascending and descending mechanism 80.

The extended state of the lower drawer type door 30*b* will be described in detail. When the lower drawer type door 30*b* is extended for ascending and descending, the front space S1 should be completely extended to the outside of the lower storage space 12.

In particular, a rear end L1 of the front space S1 should protrude more forwards than the cabinet 10 or a front end L2 of the door 20 as disposed above the front space S1. In order to avoid interference during ascending and descending of the ascending and descending mechanism 80, the rear end L1 of the front space S1 should protrude more forwards than the cabinet 10 or a front end L2 of the door 20 as disposed above the front space S1.

When the drawer part 32 extends for activation of the ascending and descending mechanism 80, the drawer part 32 may not be fully extended and may be extended only to a minimum distance at which interference may be prevented when ascending and descending the ascending and descending mechanism 80, as shown in FIG. 17. In this connection, at least a portion of a rear space S2 of the drawer part 32 is positioned inside the lower storage space 12. That is, at least the rear end L3 of the drawer part 32 should be positioned inside the lower storage space 12.

Accordingly, the lower drawer type door 30*b* may stably retract or extend and ascend or descend without tilt or breakage of the draw-out rail 33 or the lower drawer type door 30*b*, which may otherwise occur due to a weight of the food in addition to a weight of the lowered drawer type door 30*b* including the ascending and descending motor 35 and the ascending and descending mechanism 80 provided inside the door part 31.

The ascending and descending motor 35 may be provided inside the door part 31, and may be coupled to the ascending and descending mechanism 80 to provide power to ascend and descend the ascending and descending mechanism 80. The ascending and descending mechanism 80 may have a scissors deployable structure which may be configured to ascend and descend in accordance with the driving force from the ascending and descending motor 35. In another example, the configuration of the ascending and descending mechanism 80 may be various as long as it ascends and descends via the ascending and descending motor 35.

The ascending and descending motor 35 may start to work only when a full extending of the lower drawer type door 30*b* has been identified. Only when a set time duration has elapsed since the full extending of the lower drawer type door 30*b* is identified, the ascending of the ascending and descending mechanism 80 may be initiated via the ascending and descending motor 35, thereby to ensure the user safety and to prevent damage to the stored food.

In another example, when necessary, the user may instruct only the extending operation of the lower drawer type door 30*b* using a voice of the user. When after the lower drawer type door 30*b* is extended, the ascending and descending motor 35 will remain stationary. After confirming that the lower drawer type door 30*b* is fully extended, the user may again instruct the ascending operation of the lower drawer type door 30*b* using her/his voice.

Figure 18:
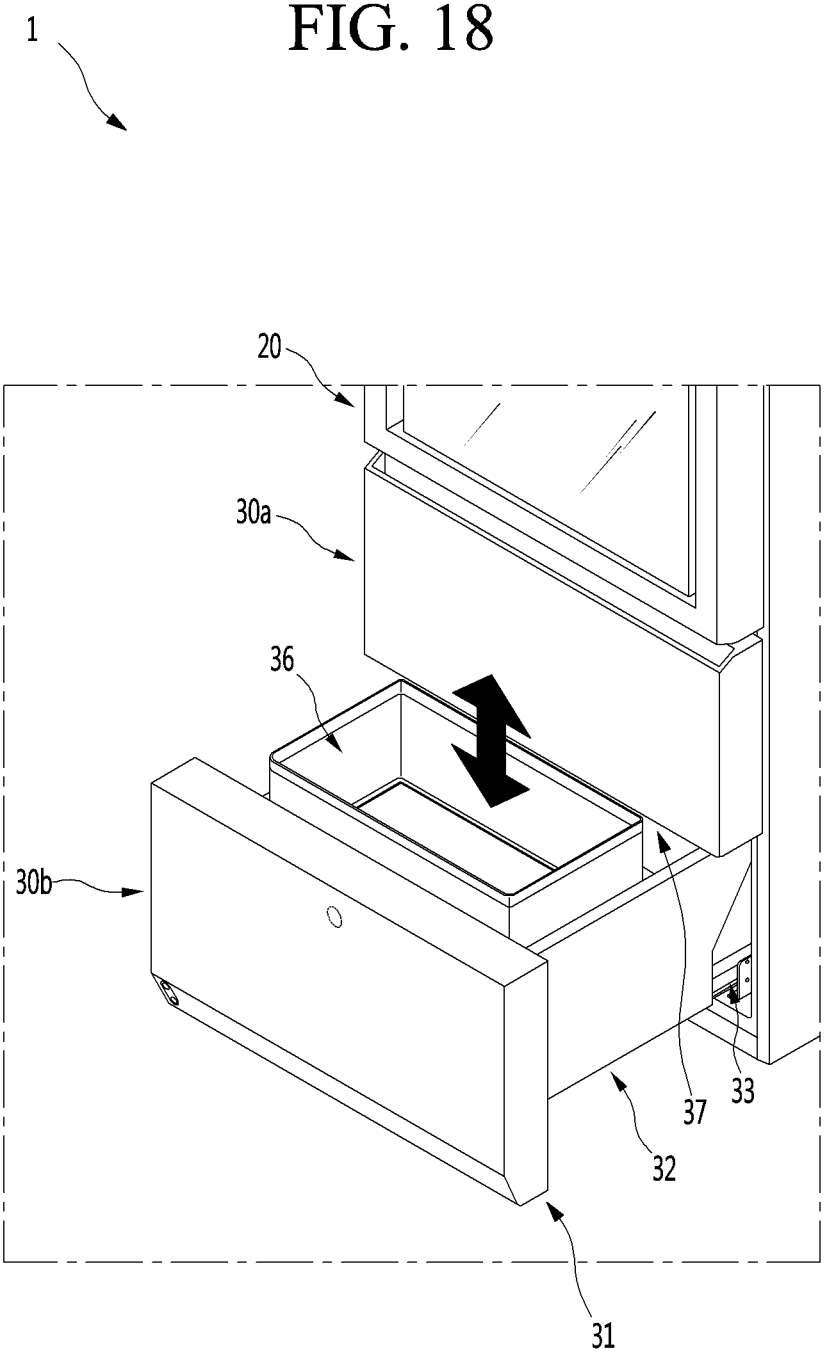
FIG. 18 is a perspective view of a state in which the lower door has been extended and the container has ascended.
Figure 19:
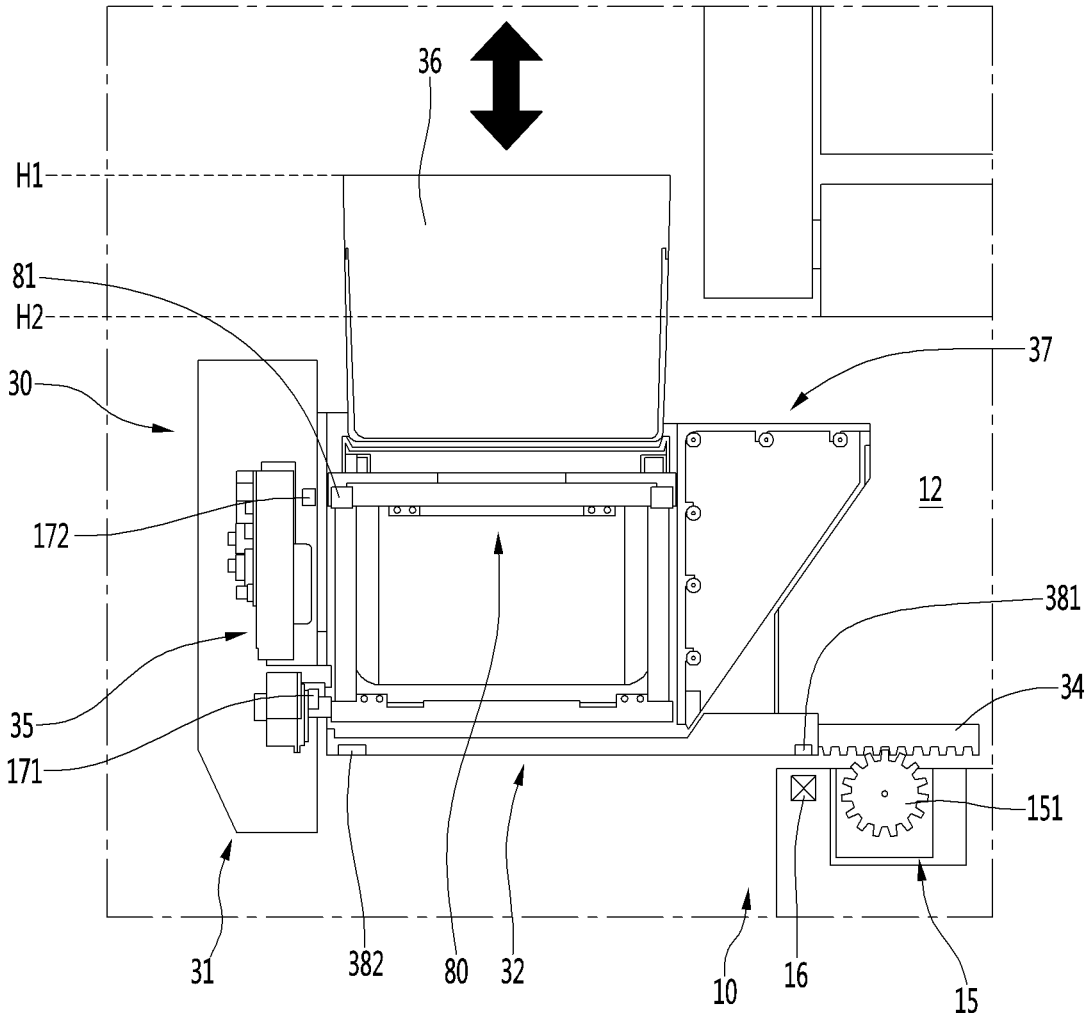
FIG. 19 shows an interior of the lower door of FIG. 18.

FIG. 18 is a perspective view of a state in which the lower door has been extended and the container has ascended. FIG. 19 shows an interior of the lower door of FIG. 18.

When an activation signal of the ascending and descending motor 35 is inputted while the lower drawer type door 30*b* has been extended, the ascending and descending motor 35 works. The ascending and descending motor 35 continues to work until the ascending of the ascending and descending mechanism 80 allows the container 36 to reach a state as shown in FIG. 18.

When the ascending and descending motor 35 starts to work, power is transferred to the ascending and descending mechanism 80, such that the ascending and descending mechanism 80 starts to ascend. Thus, the container 36 supported on the ascending and descending mechanism 80 ascends past an open top of the drawer part 32.

The ascending and descending mechanism 80 continues to ascend and stops when the ascending and descending mechanism 80 reaches a sufficient vertical level to facilitate access by the user to the food or container 36 as seated on the ascending and descending mechanism 80 as shown in FIG. 18. In this state, the user can easily lift the food or container 36 without over-bending a waist.

In one example, the ascending and descending detection sensor may sense whether the ascending and descending mechanism 80 has fully ascended or descended. The ascending and descending detection sensor may include a magnet 81 provided on the ascending and descending mechanism 80 and magnetic sensors 171 and 172 for detecting the magnet 81, wherein two first magnetic sensors 171 may be disposed on both sides of the door part at a vertical level corresponding to the maximum descending level of the ascending and descending mechanism 80 while two second magnetic sensors 172 may be disposed on both sides of the door part at a vertical level corresponding to the maximum ascending level of the ascending and descending mechanism 80.

That is, when the magnetic sensors 172 on the door part 31 detects the magnet 81 as shown in FIG. 19, it may be determined that the ascending of the ascending and descending mechanism 80 is completed. Thus, a forward rotation of the ascending and descending motor 35 can be stopped.

Further, when the ascending and descending mechanism 80 is descending, the same principle may be applied. That is, when the magnetic sensors 171 on the door part 31 detects the magnet 81, it is determined that the descending of the ascending and descending mechanism 80 is completed. Thus, a reward rotation of the ascending and descending motor 35 stops.

After the user has store food or picked up the food into or from the container, the user inputs a voice for descending of the ascending and descending mechanism 80 and for retracting the lower drawer type door 30*b*. Thus, first, the ascending and descending motor 35 works, and then the ascending and descending mechanism 80 starts to descend.

The descending of the ascending and descending mechanism 80 may be accomplished by the reverse rotation of the ascending and descending motor 35. The descending of the ascending and descending mechanism 80 may be accomplished slowly in an opposite process to the ascending process as described above.

When the descending of the ascending and descending mechanism 80 is completed, the current state reach a state as shown in FIG. 17. In this connection, the descending completion of the ascending and descending mechanism 80 is detected by the ascending and descending detection sensor. When the magnet 81 is sensed by the magnetic sensor 171 as positioned at a lower level, the controller determines that descending of the ascending and descending mechanism 80 is completed and the ascending and descending motor 35 stops.

After the stopping of the ascending and descending motor 35, the lower drawer type door 30*b* may be retracted using the retracting and extending motor 15. When the fully retracted state of the lower drawer type door 30*b* is detected by the retracting and extending detection sensor, the retracting and extending motor 15 stops. When the lower drawer type door 30*b* is completely closed, the current state may reach a state shown in FIG. 15.

Thus, only with the voice input of the user, the lower door 30 may move consecutively from the extending operation to ascending operation. Again, using the user voice input, the lower drawer type door 30*b* may continuously move from the descending operation to the retracting operation.

Thus, the user can control the operation of the lower door 30 using his/her voice even when the user is holding goods by hands or cannot otherwise manipulate the manipulation unit 301 or 302 directly. In another example, the manipulation units 301 and 302 may be omitted as needed. This may create a cleaner and more luxurious look of the refrigerator.

The following effects may be expected in the refrigerator and the control method of the refrigerator according to implementations of the present disclosure.

For example, the user may use the voice input to drive the driving mechanism while holding the object in both hands, such that the lower door may automatically retract or extend and ascend and descend, thereby improving the convenience of the user.

Further, since the lower door and upper door may be opened and closed by the voice of the user, the manipulation structure such as the button exposed to the outside may be omitted. Further, the structure of the handle or the like may be omitted or minimized so that the appearance of the refrigerator may be neat and more luxurious.

Moreover, the microphone module for receiving the voice command is housed inside the cap decoration of the top of the door. The sound input hole is formed in the top of the cap decoration. This can have the advantage that the voice recognition ability can be improved while preventing direct exposure of the microphone module to the user.

In particular, the voice input hole is defined in the inclined portion of the protruding microphone-module mount, such that it is advantageous that the voice input hole may be defined at a minimum protrusion height. Further, the voice input hole formed in the inclined portion may be visually invisible to the user's eyes, so that voice recognition can be effectively performed and at the same time the voice input hole can be prevented from being exposed to the user.

Further, the microphone module is mounted on the door cover so that the operation noise or shock of the refrigerator may not be transmitted directly thereto. The module hangs from the door cover in the top recess. Thus, it is possible to minimize the effect of the noise and vibration transmitted from the refrigerator cabinet on the microphone module. Therefore, it may be expected that voice recognition performance is improved by reducing the noise effect.

Further, the microphone module can be maintained in a steady mounted state due to the stable support of the module by the microphone-module support even when the door is repeatedly opened and closed.

Further, the microphone module is provided with the sealing member sealing between the substrate on which the microphone element is mounted and the bottom face of the door cover, thereby blocking the noise from entering the microphone module. In addition, even when an impact is applied to the door, the sealing member having elasticity may buffer the impact, thereby to protect the microphone module and to allow noise caused by the impact to be reduced. Therefore, there is an advantage in that possibility of false input of the voice is reduced and the voice recognition performance can be improved.

Further, the microphone module may be more closely attached to the cover using the microphone-module support. Therefore, this may prevent noise from entering the microphone module. Further, there is an advantage that a rigidly mounted state of the microphone module can be maintained against repetitive shocks caused by the opening and closing of the door.

Further, inside the top recess, the voice recognition module connected to the microphone module may be received. Therefore, the door cover is opened and then the microphone module and the speaker module are separated from the door cover in the event of the maintenance, so that the service and maintenance can be facilitated.

Further, the voice recognition module may communicate with the remote server. Therefore, the voice signal from the microphone module may be transmitted to the server. Then, on the server, the voice signal may be processed and analyzed in a natural language. Then, the processing result may be used to activate the driving mechanism and the operation of the refrigerator.

In other words, when the performance of the server located at a remote site is secured, the voice recognition module is configured merely to be able to communicate with the sever. Thus, the voice recognition module of a minimum size may be placed on the upper door. Therefore, the space loss for the insulation of the upper door may be minimized. When the upper door has a transparent auxiliary door, there can be an advantage that a sufficient space for installing the auxiliary door may be ensured.

Further, there may be an advantage of being able to reduce the manufacturing cost of the refrigerator by more simply configuring the voice recognition module.

In addition, the performance of the server which has relatively less limitations in terms of the space and cost constraints may be secured. This can significantly improve voice processing and recognition performance. This can also lead to the advantage of ensuring the operation reliability of the refrigerator via the voice command.

The implementations of the present disclosure as disclosed in the present specification and drawings are merely illustrative of specific examples for purposes of understanding of the present disclosure, and, thus, are not intended to limit the scope of the present disclosure. It will be apparent to those skilled in the art that other variations based on the technical idea of the present disclosure other than the implementations disclosed herein may be feasible.

What is claimed is:

1. A refrigerator comprising:

a cabinet having an upper storage chamber and a lower storage chamber defined therein;

an upper door configured to open and close the upper storage chamber;

a lower door positioned below the upper door and configured to be extended out of and retracted into the lower storage chamber, the lower door including:

an inner portion having a storage space defined therein and configured to accommodate a container or food, and an outer portion provided in front of the inner portion and configured to open and close the lower storage chamber based on the lower door being extended and retracted, respectively;

a draw-out rail provided between an inner surface of the lower storage chamber and an outer face of the lower door, the draw-out rail being configured to guide a movement of the lower door into and out of the lower storage chamber;

an ascending and descending mechanism provided at the inner portion of the lower door and configured to ascend and descend the storage space;

a driving mechanism provided at the outer portion of the lower door and configured to provide a driving force to the ascending and descending mechanism;

a controller provided at the cabinet and configured to control the driving mechanism;

a microphone module provided at the upper door and configured to receive a voice input from a user; and a voice recognition module configured to allow the controller to control the driving mechanism in response to the voice input from the user, wherein a microphone-module mount on which the microphone module is mounted is provided at a top of the upper door, the microphone-module mount including:

a protrusion protruding upward from the cover, and an inclined portion extending forward from a front face of the protrusion, the inclined portion having a bottom face that is inclined downward in a front direction, and wherein a voice input hole is defined in the inclined portion.

2. The refrigerator of claim 1, wherein the voice recognition module includes a communication unit configured to communicate with a remote server, wherein the communication unit is configured to transmit the voice input from the voice recognition module to the server and subsequently receive a processing result of the voice input from the server.

3. The refrigerator of claim 2, wherein the controller is configured to control the driving mechanism based on the processing result received from the server.

4. The refrigerator of claim 2, wherein the upper door includes a display configured to indicate an operation status of the refrigerator, wherein the display is electrically connected to the voice recognition module and configured to display the processing result received from the server.

5. The refrigerator of claim 2, wherein the communication unit is configured, based on the server receiving a voice signal that includes a predefined voice or word, to initiate communication between the server and the voice recognition module.

6. The refrigerator of claim 1, wherein the driving mechanism includes:

a retracting and extending motor disposed at one side of the cabinet and configured to provide power for retracting or extending the lower door; and an ascending and descending motor linked to the ascending and descending mechanism and configured to provide power for ascending and descending the ascending and descending mechanism.

7. The refrigerator of claim 6, wherein the controller is configured to sequentially operate the retracting and extending motor and the ascending and descending motor in response to the voice input from the user, the ascending and descending mechanism being configured to ascend based on the lower door being extended or the lower door being configured to retracted based on the ascending and descending mechanism being descended.

8. The refrigerator of claim 6, wherein the controller is configured to operate one of the retracting and extending motor or the ascending and descending motor in response to the voice input from the user.

9. The refrigerator of claim 1, wherein the top of the upper door defines a top recess that is configured to receive therein the microphone module and the voice recognition module, wherein a cover is disposed to block an open top face of the top recess, wherein the microphone-module mount provided on the cover.

10. The refrigerator of claim 1, wherein a hole guide protrudes around the voice input hole, and wherein a protrusion dimension of the hole guide decreases in a downward direction such that a bottom face of the hole guide has a slope greater than a slope of the bottom face of the inclined portion.

11. The refrigerator of claim 1, wherein the microphone module includes:

a microphone substrate extending along and disposed on the inclined portion, wherein a substrate hole is defined in the microphone substrate at a position corresponding to the voice input hole;

a sealing member disposed on a front face of the microphone substrate to seal between the microphone substrate and the inclined portion; and a microphone element placed on a rear face of the microphone substrate to block the substrate hole, wherein the sealing member has a through-hole defined therein that is in communication with the voice input hole and the substrate hole.

12. The refrigerator of claim 11, wherein two microphone elements are disposed on both sides of the microphone substrate respectively, wherein the voice input hole includes two voice input holes, the substrate hole includes two substrate holes, and the through-hole includes two through-holes, and wherein the two voice input holes, the two substrate holes, and the two through-holes are aligned linearly with the two microphone elements, respectively.

13. The refrigerator of claim 1, wherein a microphone-module support supporting the microphone module thereon is mounted on a bottom face of the microphone-module mount, wherein the microphone-module support includes:

a mounting face portion in contact with and coupled to the protrusion, and a supporting face portion extending from a front end of the mounting face portion at a same inclination angle as the inclined portion, and wherein the microphone module is mounted on the supporting face portion.

14. The refrigerator of claim 9, wherein the refrigerator further comprises a speaker module received in the top recess, the speaker module being electrically connected to the voice recognition module, and wherein a speaker-module receiving portion is recessed in the cover, the speaker module being received in the speaker-module receiving portion.

15. A method for controlling a refrigerator having an upper door for opening and closing an upper storage space in a cabinet, a lower door for opening and closing a lower storage space in the cabinet, wherein the lower door is configured to retract into or extend from the lower storage space, an ascending and descending mechanism for ascending and descending the lower door, a driving mechanism for supplying power for retracting and extending the lower door or for ascending and descending of the ascending and descending mechanism or both, a controller disposed on the cabinet for controlling the driving mechanism, a microphone module disposed on the upper door for receiving a voice from a user, and a voice recognition module disposed on the upper door and electrically connected to the microphone module and controller, wherein a microphone-module mount on which the microphone module is mounted is provided at a top of the upper door, the microphone-module mount including: (i) a protrusion protruding upward from the cover, and (ii) an inclined portion extending forward from a front face of the protrusion such that the inclined portion has a bottom face that is inclined downward in a front direction, wherein a voice input hole is defined in the inclined portion, and wherein the voice recognition module is configured to communicate with a remote server, the method comprising:

transmitting a voice signal of the user from the microphone module to the voice recognition module;

transmitting the voice signal from the voice recognition module to the server;

processing the voice signal by the server and transmitting a processing result from the server back to the voice recognition module; and controlling, by the controller, the driving mechanism to be activated based on the processing result.

16. The method of claim 15, further comprising initiating communication between the server and the voice recognition module based on the server receiving the voice signal that includes a predefined voice or word.

17. The method of claim 15, wherein the driving mechanism includes:

a retracting and extending motor disposed at one side of the cabinet for supplying power for retracting or extending the lower door thereto; and an ascending and descending motor linked to the ascending and descending mechanism for supplying power for ascending and descending the ascending and descending mechanism thereto, wherein the controller is configured to operate the retracting and extending motor or the ascending and descending motor or both based on the processing result from the server.

18. The method of claim 17, wherein the controller is configured to sequentially operate the retracting and extending motor and the ascending and descending motor in response to the voice from the user, the ascending and descending mechanism being configured to ascend based on the lower door being extended or the lower door being configured to retracted based on the ascending and descending mechanism being descended.

19. The method of claim 17, wherein the controller is configured to activate one of the retracting and extending motor or the ascending and descending motor in response to the voice from the user.

* * * * *